US009510661B2

(12) United States Patent
Murdoch et al.

(10) Patent No.: US 9,510,661 B2
(45) **Date of Patent: *Dec. 6, 2016**

(54) BACKPACK AND WAIST BAG CARRYING SYSTEM

(71) Applicant: Think Tank Photo, Inc., Santa Rosa, CA (US)

(72) Inventors: Douglas Harland Murdoch, Santa Rosa, CA (US); Michael Sturm, Redding, CA (US)

(73) Assignee: Think Tank Photo, Inc., Santa Rosa, CA (US)

( * ) Notice: Subject to any disclaimer, the term of this patent is extended or adjusted under 35 U.S.C. 154(b) by 8 days.

This patent is subject to a terminal disclaimer.

(21) Appl. No.: 14/476,730

(22) Filed: Sep. 3, 2014

(65) Prior Publication Data

US 2015/0053735 A1 Feb. 26, 2015

Related U.S. Application Data

(63) Continuation-in-part of application No. 13/842,825, filed on Mar. 15, 2013, now Pat. No. 9,027,813, which is a continuation-in-part of application No. 13/673,988, filed on Nov. 9, 2012, now Pat. No. 8,814,016.

(60) Provisional application No. 61/558,307, filed on Nov. 10, 2011.

(51) Int. Cl.
*A45F 3/04* (2006.01)
*A45F 3/00* (2006.01)

(52) U.S. Cl.
CPC ..... *A45F 3/04* (2013.01); *A45F 3/005* (2013.01); *A45F 2003/045* (2013.01)

(58) Field of Classification Search
CPC ..... A45F 3/04; A45F 2003/045; A45F 2004/144; A45F 3/14; A45F 3/047; A45F 3/00; A45F 2200/0533; A45F 4/02; A45F 3/08; A45F 2003/025; A45C 7/0086; A45C 11/38
USPC ..... 224/195, 581–583, 628, 630, 631, 645, 224/646, 647–650, 652, 654, 672, 676, 224/681–683, 901–901.8
See application file for complete search history.

(56) References Cited

U.S. PATENT DOCUMENTS 4,318,502 A 3/1982 Lowe et al.
4,523,703 A 6/1985 McKenna (Continued)

FOREIGN PATENT DOCUMENTS

EP 1 876 919 B1 3/2010
FR 2646594 A1 11/1990

(Continued)

OTHER PUBLICATIONS

WO 2013/071195 A1 (includes the international search report for application PCT/US2012/064560)., May 16, 2013, Think Tank Photo, Inc.

(Continued)

*Primary Examiner* — Adam Waggenspack
(74) *Attorney, Agent, or Firm* — R. Dabney Eastham

(57) ABSTRACT

The invention provides improved backpack and waist bag carrying systems in which a waist bag rotates through a lower compartment of a backpack to allow the bearer of the backpack to access the contents of the receiver of the waist bag by rotating the waist bag to the front of the bearer's torso.

8 Claims, 21 Drawing Sheets

(56) References Cited

U.S. PATENT DOCUMENTS

| | | | | |
|---|---|---|---|---|
| 5,184,763 | A | 2/1993 | Blaisdell et al. | |
| 5,205,448 | A | 4/1993 | Kester et al. | |
| 5,228,609 | A | 7/1993 | Gregory | |
| 5,240,159 | A | 8/1993 | Gregory | |
| 5,487,498 | A | 1/1996 | Gleason | |
| 5,540,364 | A | 7/1996 | Krieger et al. | |
| 5,632,429 | A | 5/1997 | Cantwell | |
| 5,673,836 | A | 10/1997 | Bush | |
| 5,934,527 | A | 8/1999 | Von Neumann | |
| 5,934,533 | A | 8/1999 | Callanan | |
| 5,964,384 | A | 10/1999 | Young | |
| 6,098,857 | A * | 8/2000 | Le Gal | A47D 13/025 224/153 |
| 6,189,750 | B1 | 2/2001 | Von Neumann | |
| 6,619,519 | B1 | 9/2003 | Nix et al. | |
| 6,722,543 | B1 | 4/2004 | Fitzgerald et al. | |
| 7,000,812 | B2 | 2/2006 | Gilstrap et al. | |
| 8,814,016 | B2 * | 8/2014 | Murdoch | A45F 3/04 224/581 |
| 9,027,813 | B2 * | 5/2015 | Murdoch | A45F 3/04 224/637 |
| 2003/0121945 | A1 | 7/2003 | Lemanski, II | |
| 2006/0097019 | A1 | 5/2006 | Just-Buddy | |
| 2008/0302839 | A1 * | 12/2008 | Murdoch | A45F 3/04 224/153 |
| 2010/0012696 | A1 | 1/2010 | Prager | |
| 2010/0230458 | A1 | 9/2010 | Kramer | |

FOREIGN PATENT DOCUMENTS

| | | | |
|---|---|---|---|
| JP | 60-172527 | | 11/1985 |
| JP | 2005-074131 | | 3/2005 |
| KR | 10-1999-0075270 | A | 10/1999 |
| KR | 10-2004-0106204 | A | 12/2004 |
| WO | WO 2001-26502 | A1 | 4/2001 |

OTHER PUBLICATIONS

Response to Rule 161 and 162 EPC communication sent to EPO on Jan. 20, 2008 and received by the EPO on Jan. 31, 2008.

Invitation from the examining division pursuant to Article 94(3) and Rule 71(1) EPC, dated Dec. 12, 2008.

Reply to the invitation pursuant to Article 94(3) and Rule 71(1) EPC, sent on May 12, 2009 and received by the EPO on Jun. 4, 2009.

Communication of intent to grant pursuant to Rule 71(3) EPC, dated Jul. 17, 2009.

Decision to grant pursuant to Rule 97(1) EPC, dated Feb. 11, 2010.

Written opinion of the International Searching Authority for application PCT/US2012/064560 of Think Tank Photo, Inc.

* cited by examiner

BACKPACK AND WAIST BAG CARRYING SYSTEM

CROSS-REFERENCE TO RELATED APPLICATIONS

This non-provisional patent application is a continuation-in-part of U.S. non-provisional patent application Ser. No. 13/842,825, filed on Mar. 15, 2013 and titled "BACKPACK AND WAIST BAG CARRYING SYSTEM," the contents of which are incorporated herein by reference for all purposes. U.S. non-provisional patent application Ser. No. 13/842,825 was a continuation-in-part of U.S. non-provisional patent application Ser. No. 13/673,988 filed on Nov. 9, 2012 and titled "BACKPACK AND WAIST BAG CARRYING SYSTEM," the contents of which are incorporated herein by reference for all purposes. (U.S. non-provisional patent application Ser. No. 13/673,988 issued on Aug. 26, 2014 as U.S. Pat. No. 8,814,016 B2.) U.S. non-provisional patent application Ser. No. 13/673,988 claimed the benefit of and priority under 35 U.S.C. §119(e) of U.S. provisional patent application Ser. No. 61/558,307, filed on Nov. 10, 2011 and titled "BACKPACK AND WAIST BAG CARRYING SYSTEM," the contents of which are incorporated herein by reference for all purposes.

FIELD OF THE INVENTION

The field of the invention is that of carriers for articles to be borne by animate bearers, and, in particular, that of backpacks.

BACKGROUND OF THE INVENTION

The inventors are the named inventors of international patent application PCT/US2006/016708 for a "Backpack and Waist Bag Carrying System," published as WO 2006/119230 and claiming priority from U.S. provisional application 60/676,257 filed on 30 Apr. 2005. The backpack and waist bag carrying system described in these applications are believed to be the first system in which a waist bag may be easily deployed to the front of the user while the user is wearing the backpack on his or her back. The contents of international application PCT/US2006/016708 and provisional application U.S. 60/676,257 are incorporated by reference in this application as if fully set forth herein. U.S. non-provisional patent application Ser. No. 11/667,582 was filed as the national phase of international application PCT/US2006/016708 and issued as U.S. Pat. No. 8,690,582 B2.

SUMMARY OF THE INVENTION

An improved backpack and waist bag carrying system is provided of the kind that holds the receiver of a waist bag in the part of a backpack adjacent to the waist of the bearer when the backpack is borne on the back of the bearer. The backpack has openings on the right and left side through which the belt of the waist bag will pass. The receiver of the waist bag may be deployed to the front of the bearer by rotating the receiver from the lower part of the backpack, through one of the openings on the right and left side of the backpack, to the anterior side of the bearer. The receiver may be returned to the lower portion of the backpack by rotating the receiver to the posterior side of the backpack.

In one exemplary embodiment, a carrying system is provided that comprises a backpack that has a space or compartment in the lower or lumbar region of the backpack.

The backpack has right and left side openings that provide access to the compartment. The compartment can releasably contain the receiver of a waist bag when the belt of the waist bag is secured around the bearer's waist so that the bearer can rotate the waist bag about the bearer's waist to the anterior side of the bearer while the bearer is wearing the backpack on his or her posterior side or back. A door is provided to cover and secure at least one of the right and left side openings through which the receiver is deployed to pass to the anterior side of the bearer. The door is attached to the backpack and is preferably tensioned away from the one of the right and left side openings when the door is not needed to secure the opening, such as when the receiver of the waist bag is deployed to the anterior side of the bearer. A buckle preferably is provided for securing the door when the receiver is within the compartment. The buckle may secure the door to the waist bag. The receiver may be held in the space or compartment substantially by friction even when the door is not secured. The other of the right and left side openings may be sized to be no larger than needed to accommodate the belt of the waist bag so that the receiver of the waist bag may not pass through that opening. The backpack will appear to be a backpack with waist belt of the usual sort when the receiver of the waist bag is in the compartment and the door is secured.

Alternatively, the door of the carrying system may be secured to the backpack around the one of the right and left side openings with a zipper or other fastening apparatus. Both the right and left side openings each may be provided with a door secured in this way.

In yet another exemplary embodiment, a carrying system is provided that comprises a backpack that has a space or compartment in the lower or lumbar region of the backpack. The backpack has right and left side openings providing access to the space or compartment and permitting the passage of at least the belt of a waist bag. At least one of the right and left side openings is large enough to permit passage of the receiver of the waist bag. The space or compartment can releasably contain the receiver of the waist bag when the belt of the waist bag is secured around the bearer's waist so that the bearer can rotate the waist bag about the bearer's waist to the anterior side of the bearer while the bearer is wearing the backpack on his or her posterior side or back. The space or compartment for containing the receiver is formed between a body-contacting wall of the backpack and a compartment formed in the backpack that may contain articles to be carried in the backpack. In a preferred embodiment, the receiver is held in the receiver-containing compartment substantially by friction.

In still another exemplary embodiment, a carrying system is provided that comprises a backpack that has a space or compartment in the lower or lumbar region of the backpack. The backpack has right and left side openings providing access to the space or compartment and permitting the passage of at least the belt of a waist bag. At least one of the right and left side openings is large enough to permit passage of the receiver of the waist bag. The space or compartment can releasably contain the receiver of the waist bag when the belt of the waist bag is secured around the bearer's waist so that the bearer can rotate the waist bag about the bearer's waist to the anterior side of the bearer while the bearer is wearing the backpack on his or her posterior side or back. The compartment for receiving the receiver is adjacent the back of the bearer but does not occupy the whole lower or lumbar region of the backpack so that room is provided for an additional compartment for receiving articles that is located between the receiver-containing compartment and the non-body contacting wall of the backpack. A door attached to the backpack may be provided in order to secure at least one of the right and left side openings when the receiver is in the receiver-containing compartment. The door may be secured to the backpack around the one of the right and left side openings with a zipper or other fastening apparatus. Both the right and left side openings may each be provided with a door of this kind in one version of this embodiment.

In yet another exemplary embodiment, a carrying system is provided that comprises a backpack that has a space or compartment in the lower or lumbar region of the backpack. The backpack has right and left side openings providing access to the space or compartment and permitting the passage of at least the belt of a waist bag. At least one of the right and left side openings is large enough to permit passage of the receiver of the waist bag. The space or compartment can releasably contain the receiver of the waist bag when the belt of the waist bag is secured around the bearer's waist so that the bearer can rotate the waist bag about the bearer's waist to the anterior side of the bearer while the bearer is wearing the backpack on his or her posterior side or back. The compartment for receiving the receiver is adjacent the back of the bearer but does not occupy the whole lower or lumbar region of the backpack so that room is provided for an additional compartment for receiving articles that is located between the receiver-containing compartment and the non-body contacting wall of the backpack and extends between the top and bottom of the backpack. A second compartment may be provided above the receiver-containing compartment. A buckle component attached to the backpack may be provided adjacent at least one of the right and left side openings when the receiver is in the receiver-containing compartment in order to secure to a mating buckle component on the receiver of the waist bag.

DESCRIPTION OF THE DRAWINGS

Other objects, features, and advantages of the present invention will become more fully apparent from the following detailed description of preferred embodiments, the appended claims, and the accompanying drawings in which:

DETAILED DESCRIPTION OF PREFERRED EMBODIMENTS

Figure 1:
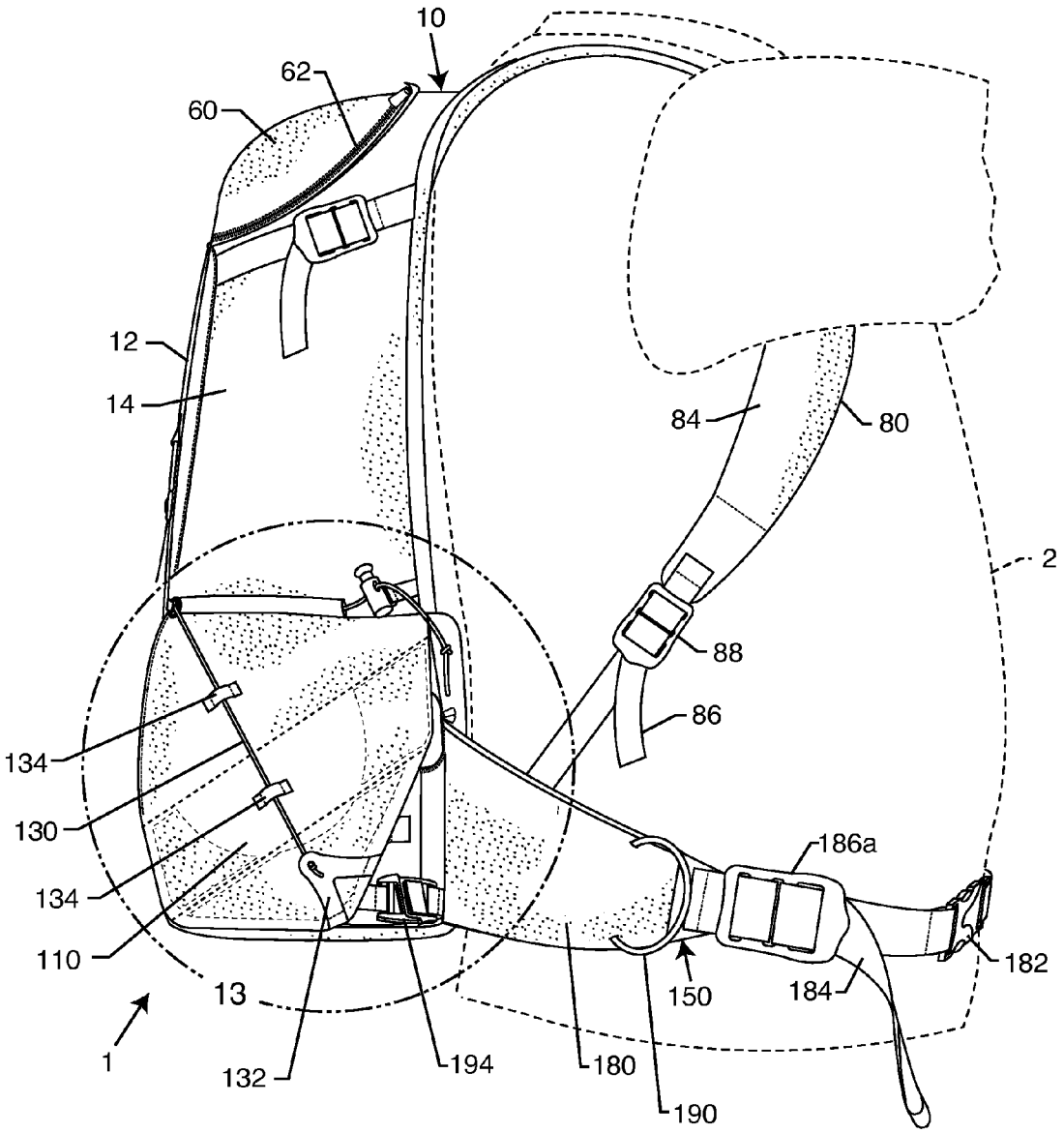
FIG. 1 is a perspective view from the right side of a first preferred embodiment of a backpack with waist bag carrying system shown being worn by a human being or bearer in a first configuration in which the receiver of the waist bag is located inside the backpack.
Figure 2:
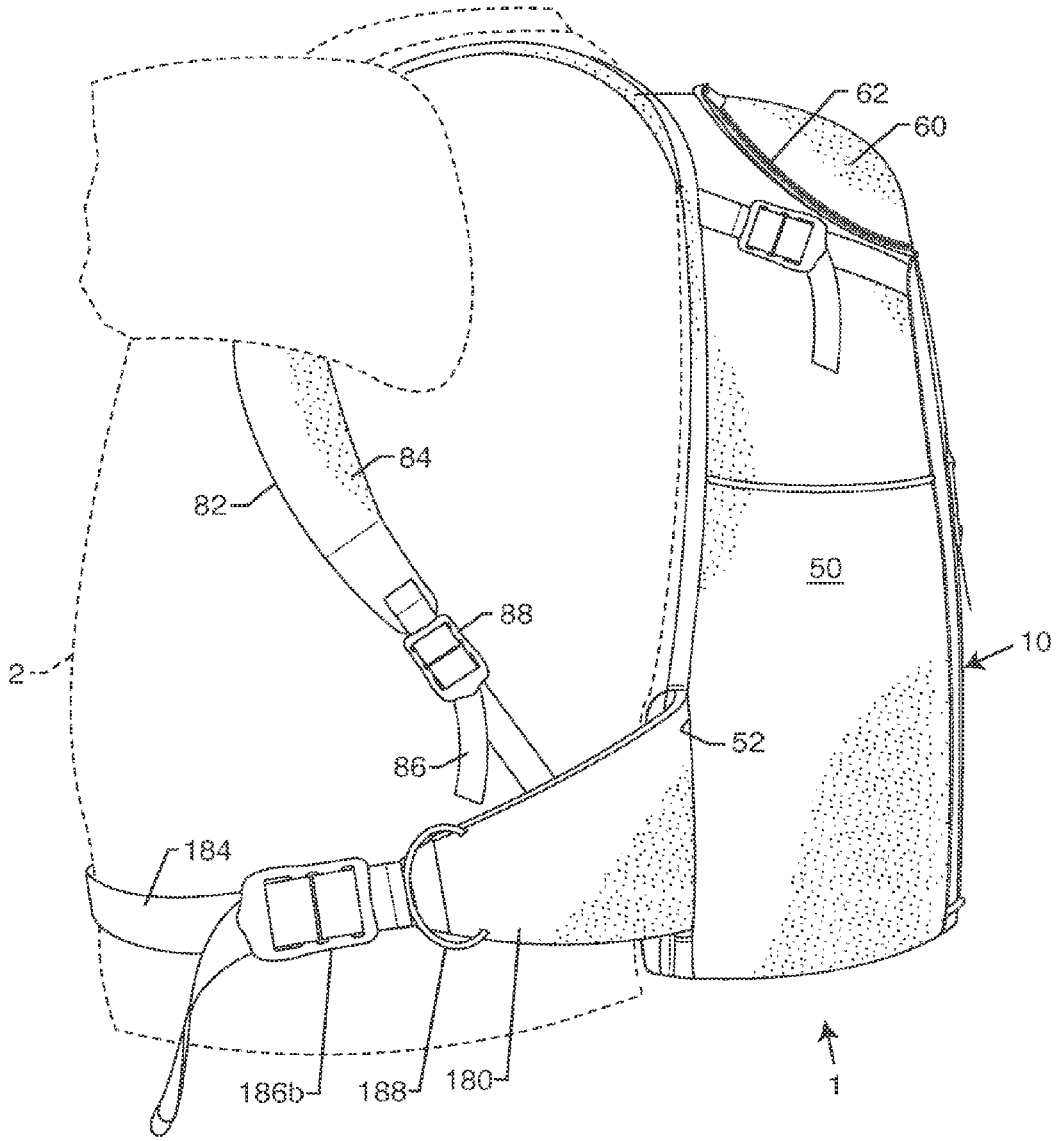
FIG. 2 is a perspective view from the left side of the first preferred embodiment of a backpack with waist bag carrying system being borne by the bearer in the first configuration in which the receiver of the waist bag is inside the backpack.

Referring now to the drawings, a first preferred embodiment of a backpack with waist bag carrying system according to the invention is indicated generally by reference numeral 1. The system 1 and its components are depicted in FIGS. 1-15.

The backpack with waist bag carrying system 1 comprises two cooperating components: a backpack 10 and a waist bag 150. The backpack 10 has a bag portion 12 defining a first or upper compartment 18, and a lower compartment 100 that receives the waist bag 150, thereby providing an operative connection between the waist bag 150 and the backpack 10. The bearer, shown in hidden line in the drawings and indicated by reference number 2, may wear the combination of the backpack 10 and the waist bag 150 just as he or she would wear a normal backpack when they are in a first configuration shown in FIGS. 1, 2, 6, and 8.

The backpack 10 has shoulder straps 80 and 82 that support the bag portion 12 of the backpack 10 on the back or posterior side of the bearer. In the first configuration, the waist bag 150 will help support the backpack 10. The waist bag 150 has a waist belt 180 encircling the waist of the bearer 2 that will support the receiver 160 of the waist bag 150 and, in the first configuration, the bag portion 12 of the backpack 10 on the back or posterior side of the bearer, by providing support from below.

In the first configuration, the configuration of the backpack with waist bag carrying system 1 shown in FIGS. 1, 2, 6, and 8, the receiver 160 of the waist bag 150 is centered in the compartment 100. The waist belt 180 of the waist bag 150 surrounds the waist, generally above the hips of the bearer, and acts as a waist belt for the backpack 10. This configuration of the backpack 10 and the waist bag 150 is similar in operation to a conventional backpack with waist belt. As will be seen, this configuration also has the appearance of a conventional backpack with waist belt because the receiver 160 is not visible to an observer.

Figure 3:
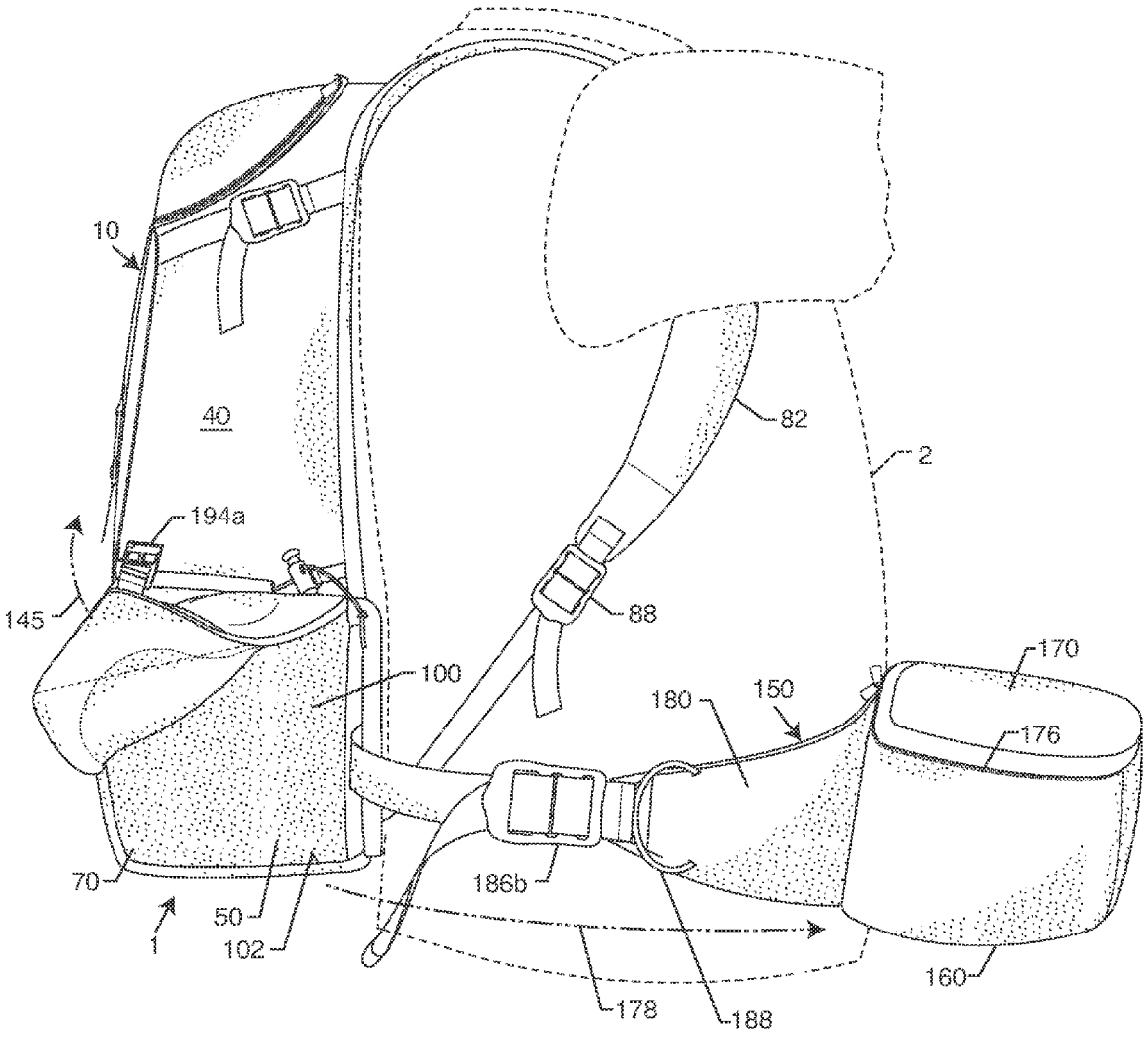
FIG. 3 is a perspective view from the right side of the first preferred embodiment of a backpack with waist bag carrying system in a second configuration in which the receiver of the waist bag is deployed in front of or on the anterior side of the bearer.
Figure 4:
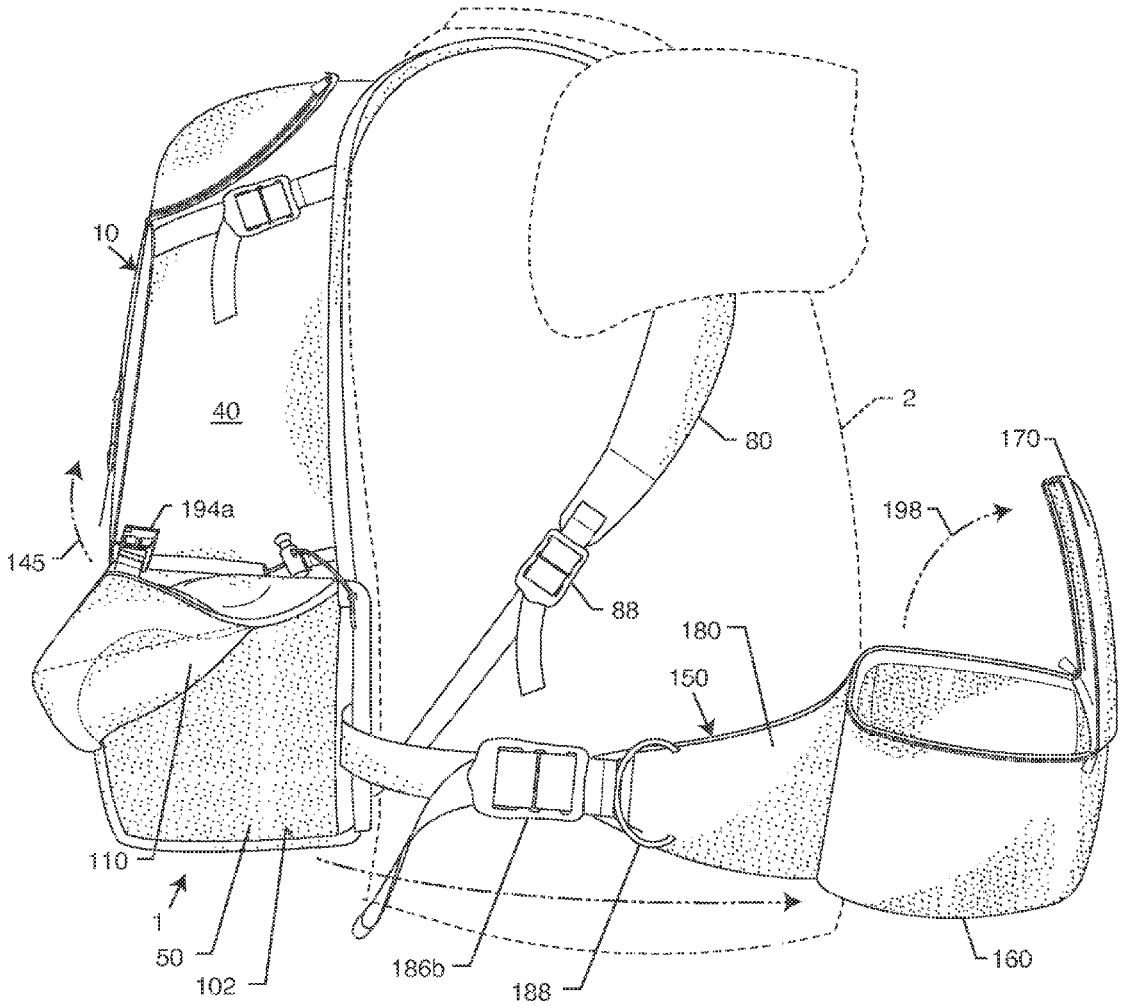
FIG. 4 is a perspective view from the right side of the first preferred embodiment of a backpack with waist bag carrying system in the second configuration in which the receiver of the waist bag is deployed in front of or on the anterior side of the bearer, with the top side of the receiver being hinged away from the bearer.
Figure 5:
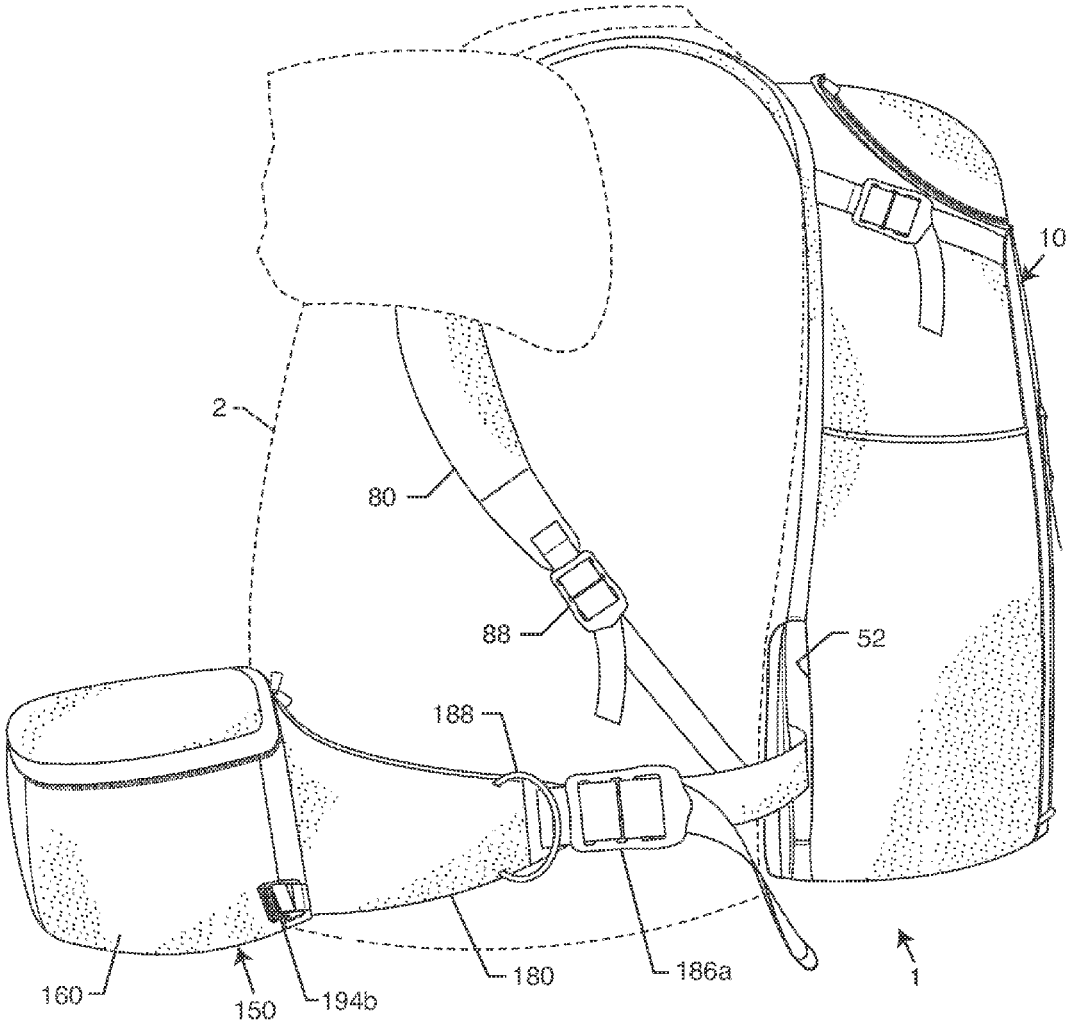
FIG. 5 is a perspective view from the left side of the first preferred embodiment of a backpack with waist bag carrying system in a second configuration in which the receiver of the waist bag is deployed in front of or on the anterior side of the bearer.
Figure 6:
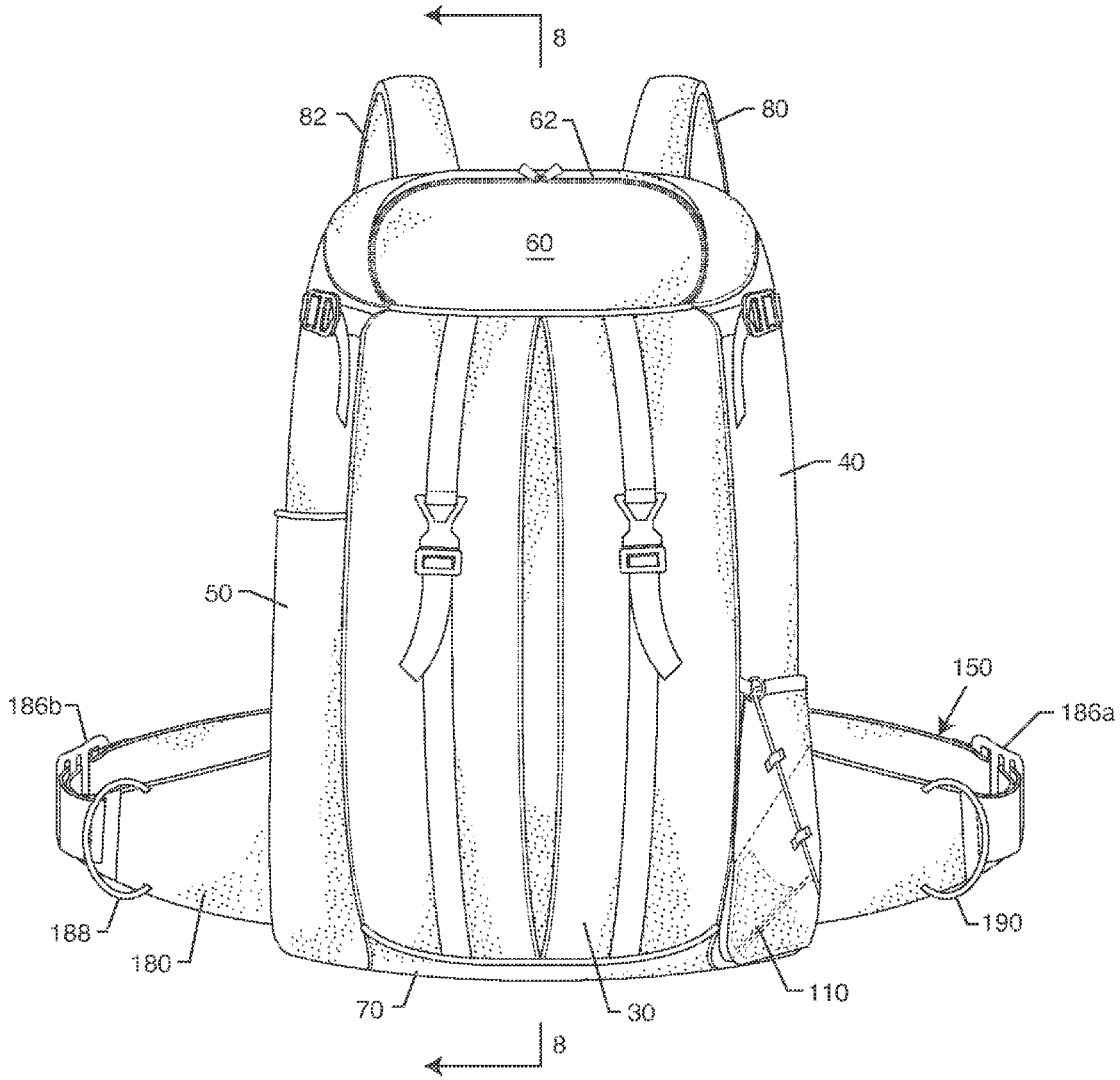
FIG. 6 is a perspective view from the front or non-body contacting side of the first preferred embodiment of a backpack with waist bag carrying system in the first configuration in which the receiver of the waist bag is deployed inside the backpack.

In the second configuration of the backpack with waist bag carrying system 1, shown in FIGS. 3-5, the bearer 2 has pulled the receiver 160 of the waist bag 150 out of the compartment 100, preferably after loosening the waist belt 180 at one or both of the buckles 186*a* and 186*b* so that the belt 180 will not resist the movement by friction with the bearer's waist, and rotated the receiver 160 of the waist bag 150 to the bearer's front or anterior side while the waist belt 180 remains buckled about the bearer's torso. It will be noted that the waist bag 150 preferably is worn over the shoulder straps 80 and 82 so that the shoulder straps 80 and 82 do not prevent rotation of the waist bag 150 by interfering with the movement of the receiver 160.

Figure 7:
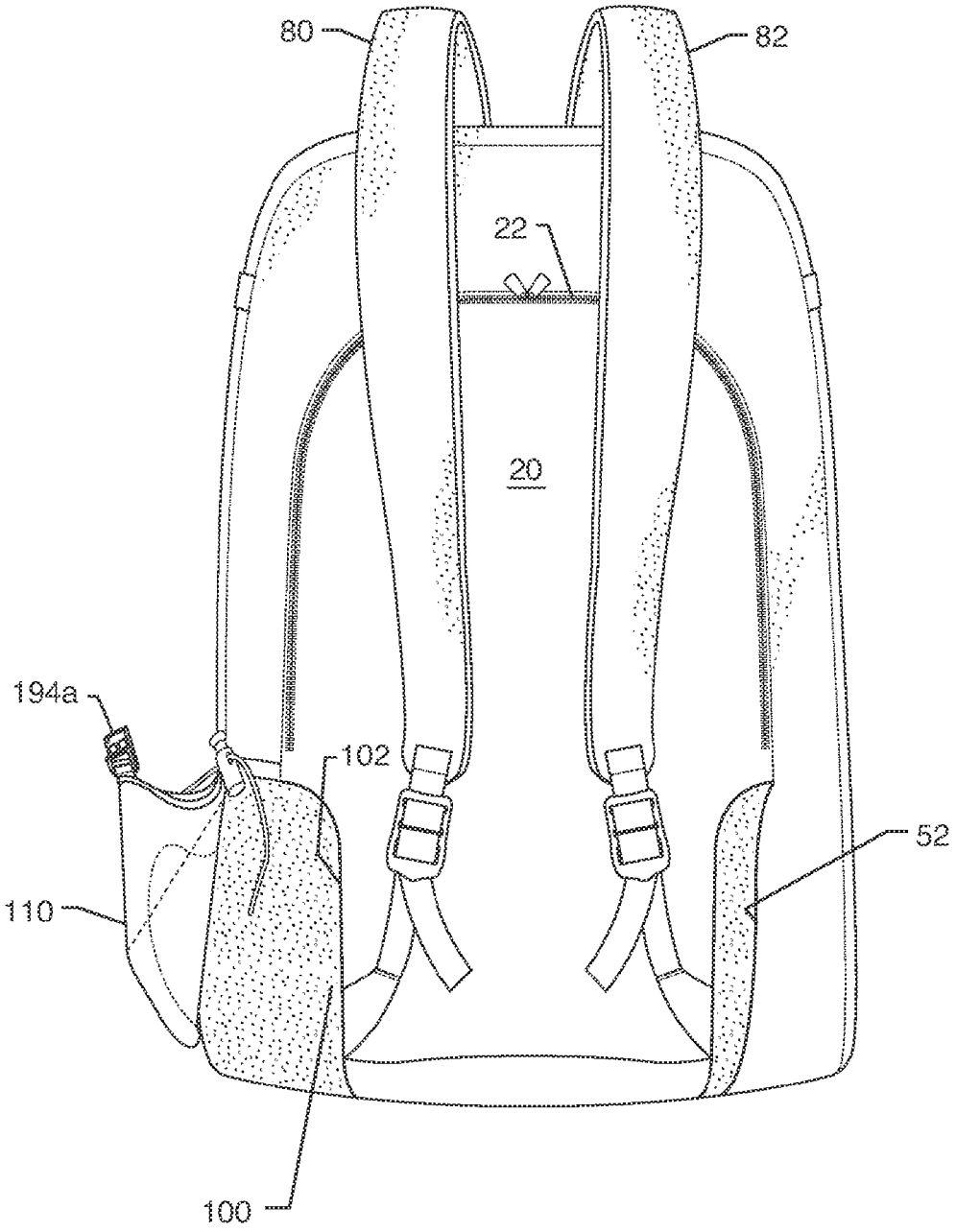
FIG. 7 is a perspective view from the back or body-contacting side of the first preferred embodiment of a backpack with waist bag carrying system, the waist bag having been removed from the backpack.
Figure 8:
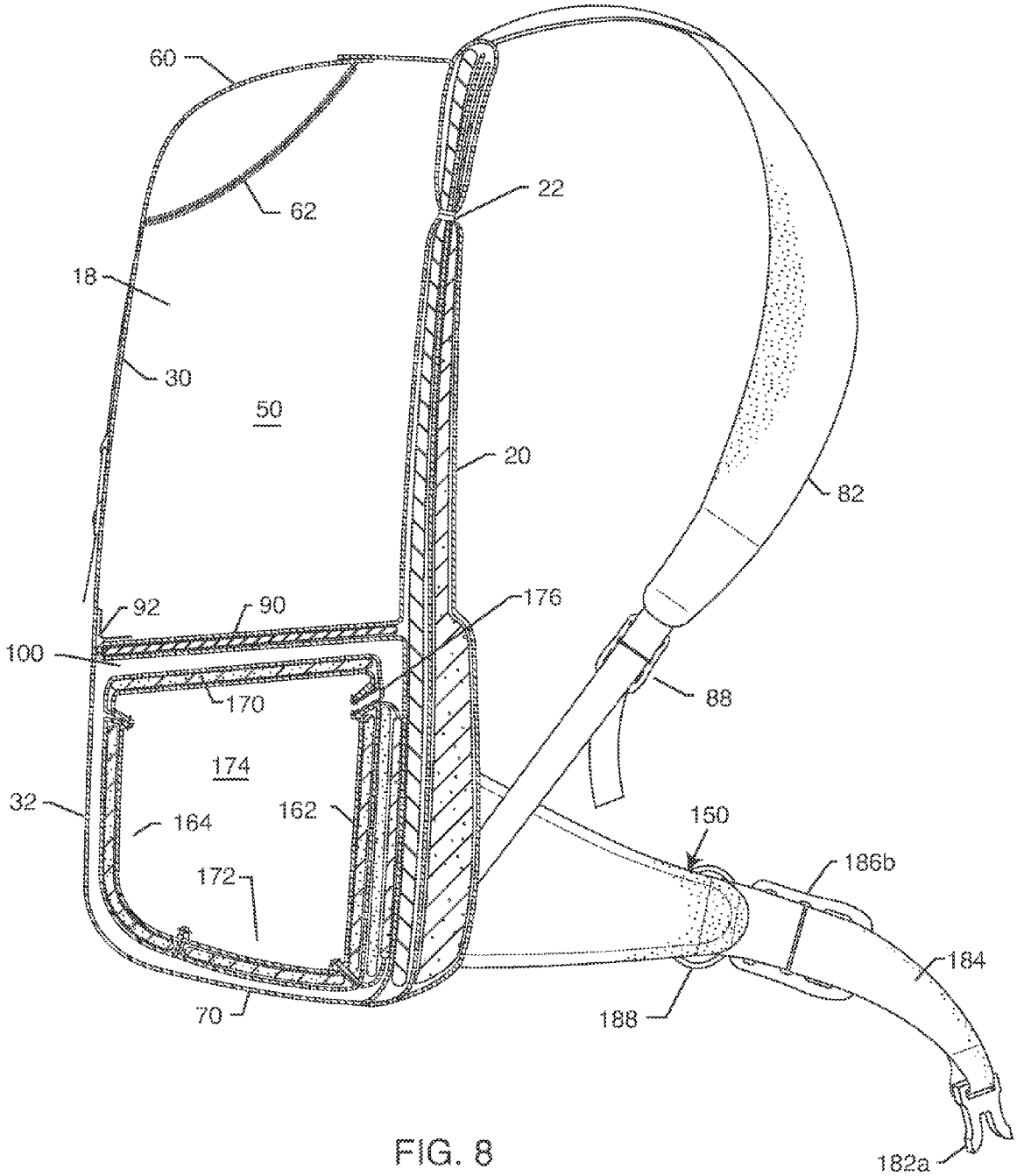
FIG. 8 is a sectional view of the first preferred embodiment of a backpack with waist bag carrying system in the first configuration in which the receiver of the waist bag is inside the backpack, taken along plane 8-8 as shown in FIG. 6.

In the first configuration the backpack with waist bag carrying system 1, the receiver 160 of the waist bag 150 is located in the lower compartment 100 of the backpack 10. The receiver 160 in combination with the waist belt 180 can support all or part of the weight of the backpack 10. This means that the bearer 2 can loosen the shoulder straps 80 and 82 so that the weight of the backpack 10 is supported on the waist bag 150 and is therefore supported on the hips of the bearer 2. The bearer 2 may even slide the shoulder straps 80 and 82 from his or her shoulders so that the backpack 10 is supported entirely by the waist bag 150. Although the upper end of the backpack 10 will tend in this configuration (not shown in the drawings) to rotate away from the bearer, the bearer will find this useful if he or she rotates the backpack 10 about his or her waist in order to access the contents of the upper compartment 18 via the opening in the body contacting wall 20 of the backpack 10 that is opened and closed by the zipper 22. FIGS. 7 and 8 show the location of the zipper 22.

The receiver 160 of the waist bag 150 may be withdrawn from the right side of the compartment 100 in the bag portion 12 of the backpack 10, while the backpack 10 is worn on the body of the bearer 2, and rotated from the bag portion 12 (and thus the posterior or rear side of the bearer 2) to the anterior or front side of the bearer 2, as in the second configuration of the backpack 10 and the waist bag 150 shown in FIGS. 3-5. The entire waist bag 150 thus is rotated around the bearer's waist without removing the backpack 10 from the bearer 2. In this configuration the bearer 2 will have access to the contents of the receiver 160 of the waist bag 150 without having to remove the backpack 10. The waist bag 150 will remain operatively connected to the backpack 10.

The bearer can shift or rotate the waist bag 150 back to the first configuration shown in FIGS. 1, 2, 6, and 8 when desired without first having to remove either the backpack 10 or the waist bag 150. When in the first configuration, the backpack with waist bag carrying system 1 may be worn on the bearer's back like a conventional backpack with a waist belt. The backpack with waist bag carrying system 1 may be removed from the bearer and carried, such as by hand, as one unit (as in FIG. 6, in which the backpack with waist bag carrying system 1 is shown by itself and not attached to a bearer). In this respect the backpack with waist bag carrying system 1, when in the first configuration, operates and may be used like any conventional backpack with a waist belt.

Figure 9:
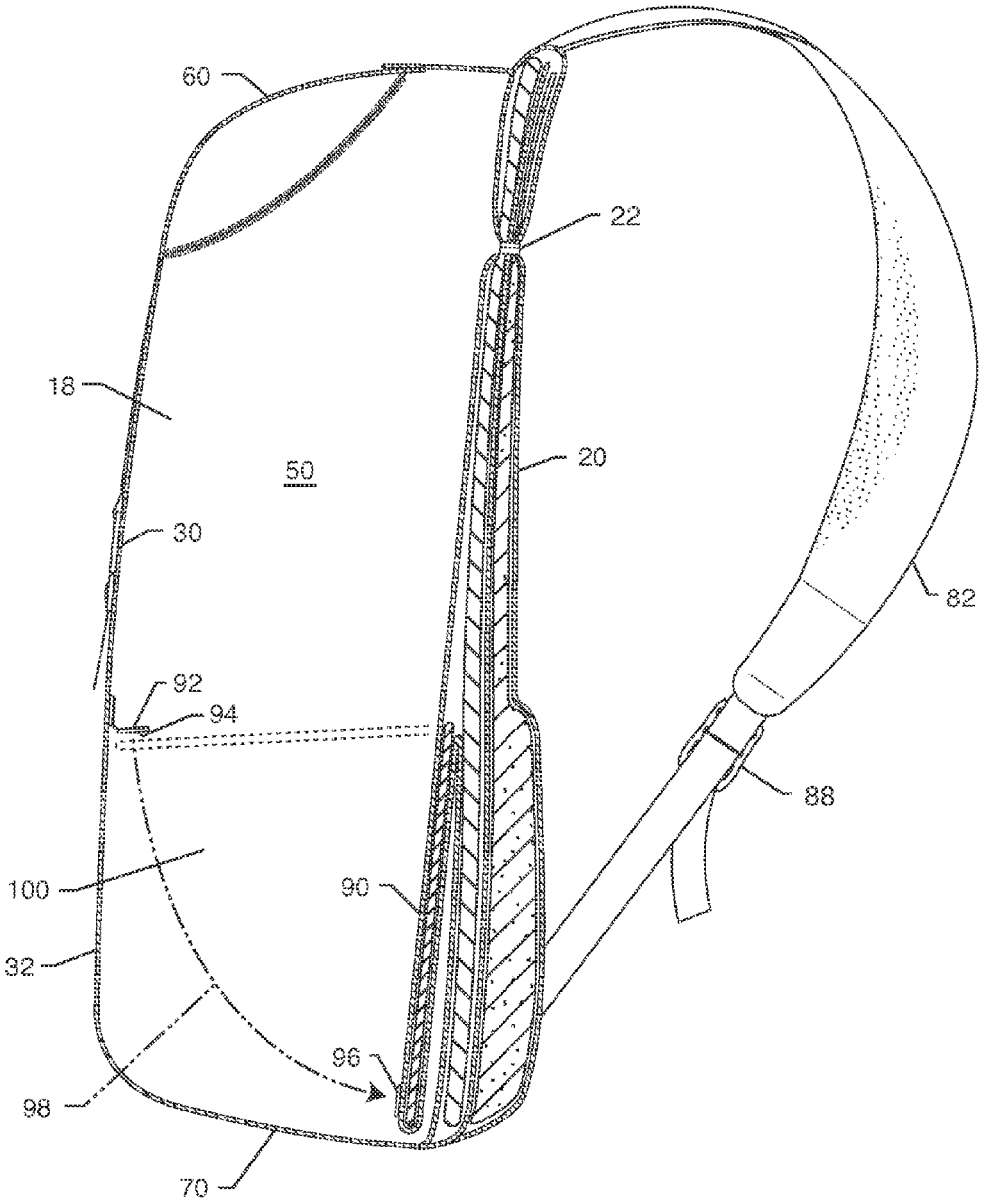
FIG. 9 is an alternate sectional view of the first preferred embodiment of a backpack with waist bag carrying system in which the waist bag is removed from the lower compartment and the middle wall is lowered against the body contacting wall of the bag portion of the backpack.
Figure 10:
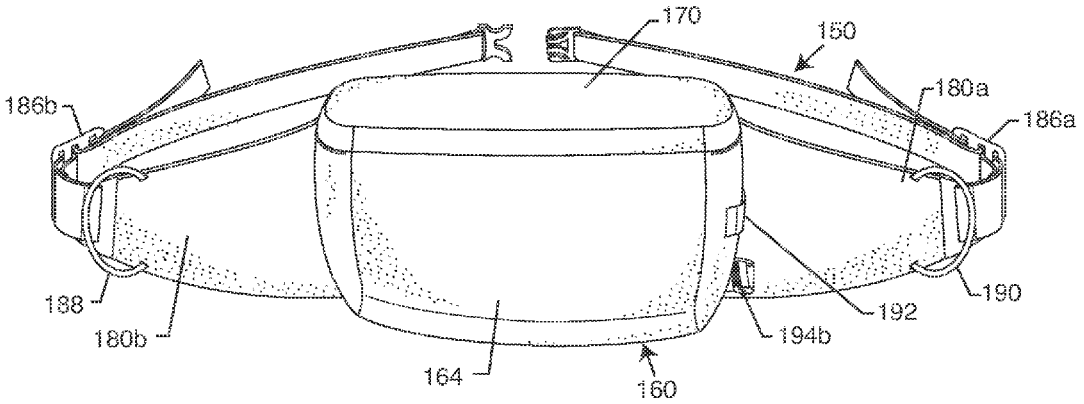
FIG. 10 is a perspective view of the front side of the waist bag of the first preferred embodiment of a backpack with waist bag carrying system.
Figure 11:
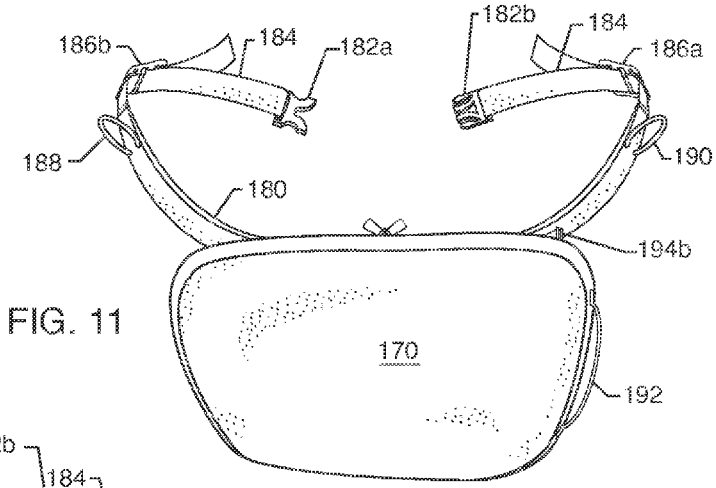
FIG. 11 is a perspective view of the top side of the waist bag of the first preferred embodiment of a backpack with waist bag carrying system.
Figure 12:
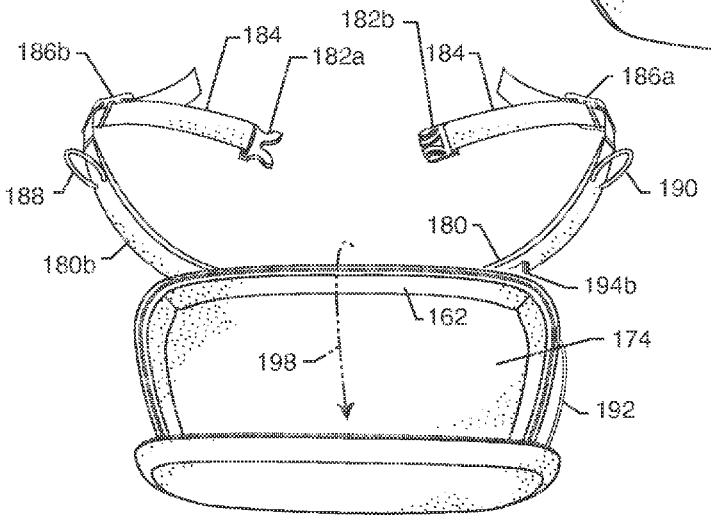
FIG. 12 is a perspective view of the top side of the waist bag of the first preferred embodiment of a backpack with waist bag carrying system, the top side of the receiver of the waist bag being shown rotated away from the body contacting side of the receiver to reveal a compartment in the receiver.

The user or bearer may wear the backpack 10 without the waist bag 150 or the waist bag 150 without the backpack 10, if desired. FIGS. 7 and 9 show the backpack 10 by itself, without any operative association with the waist bag 150. FIGS. 10-12 show the waist bag 150 by itself.

The backpack 10 shown in FIGS. 1-9 is like conventional backpacks or rucksacks in that the backpack 10 has a body contacting wall 20 and a generally opposed and parallel non-body contacting wall 30 joined by right and left side walls 40 and 50, a top wall 60, and a bottom wall 70. (In this specification, the terms right and left as used with respect to the backpack 10 and waist bag 150 refer to the bearer's right and left when the backpack 10 and the receiver 160 of the waist bag 150 are worn on the bearer's posterior side or back.) The body contacting wall 20 is also joined to the non-body contacting wall 30 by a middle or divider wall 90 that is generally parallel to and disposed between the top wall 60 and the bottom wall 70.

A wire frame 24 is located in the body contacting wall 20 as shown in FIGS. 7, 8, and 9. The wire frame 24 provides support for the body contacting wall 20.

The bag portion 12 of the backpack 10 comprises an upper or superior part 14 and a lower or inferior part 16. The upper part 14 is generally above the middle wall 90. The lower part 16 is that portion of the bag portion 12 of the backpack 10 that is generally below the middle wall 90 and will be adjacent the lumbar portion of the bearer's spine when the bag portion 12 of the backpack 10 is worn on the bearer's back.

The body contacting wall 20, the non-body contacting wall 30, the right and left side walls 40 and 50, the top wall 60, and the middle wall 90 form the upper part 14. These walls together define the first or upper compartment 18. The upper compartment 18 is accessed via an opening in the top wall 60, the right side wall 40, and the left side wall 50 that is reversibly secured by a zipper 62, and by an opening in the body contacting wall 20 that is reversibly secured by the zipper 22. The opening in the body contacting wall 20 is inside the area defined by the wire frame 24 so that the rigidity provided by the wire frame 24 is not compromised.

The lower part 16 of the backpack 10 is comprised of the body contacting wall 20, the non-body contacting wall 30, the bottom wall 70, and the middle wall 90 that define the compartment 100. The lower part 16 is the part of the bag portion 12 that will be adjacent the bearer's lumbar region and waist when the backpack 10 is worn on the bearer's back.

The middle wall 90, as shown in FIG. 8, preferably is a fabric-sheet-fabric sandwich sewn to the inner side of the body contacting wall 20. The middle wall 90 is secured to the non-body contacting wall 30 by means of corresponding hook strip 94 and loop strip 96. The hook strip 94 is attached to a flap 92 that is sewn to the non-body contacting wall 30. The loop strip 96 is attached to the end of the middle wall 90 that is adjacent the non-body contacting wall 30 when the middle wall 90 is extended to that wall.

It will be understood that the positions of the hook and loop strips 94 and 96 could be reversed. In addition, it will be understood that other devices, such as a zipper, could be employed to attach the middle wall 90 to the body contacting wall 30. It will also be understood that the middle wall 90 could be sewn to the non-body contacting wall and the hook and loop strips 94 and 96 could be used to secure the middle wall 90 to the body contacting wall 30.

FIG. 9 shows how the middle wall 90 can be detached from the non-body contacting wall 30 by detaching the hook and loop strips 94 and 96 and rotating the middle wall 90 in the direction indicated by the arrow 98 to lie against the lower part of the body contacting wall. This configuration of the middle wall 90 may be useful when the waist bag 150 is not operatively connected to the bag portion 12 of the backpack 10, as shown in FIGS. 7 and 9, and the bearer desires to carry large articles that will not fit into the upper compartment 18, such as lengthy telephoto lenses, in the bag portion 12 of the backpack 12.

Right and left flaccid supporting members or shoulder straps 80 and 82 are provided for supporting the backpack 10 when the bag portion 12 of the backpack 10 is worn on the bearer's back. Each of the shoulder straps 80 and 82 is attached at opposed ends thereof to the bag portion 12 of the backpack 10 at the top and bottom of the body contacting wall 20 and so disposed that the shoulder straps 80 and 82 will each cross over one of the bearer's shoulders when the bag portion 12 of the backpack 10 is worn on the bearer's back or posterior side. The shoulder straps 80 and 82 in the currently preferred embodiment have a conventional two-part design in which an upper padded strap portion 84 is linked to a lower unpadded strap portion 86 by a webbing adjuster buckle 88. Suitable webbing adjuster buckles for use in this and other locations of each embodiment of the backpack and waist bag carrying system of this specification are the Single Bar E-Lock webbing adjuster buckles made by the Woojin Plastic Company, a company based in the Republic of Korea.

The waist bag 150 shown in FIGS. 1-6, 8, and 10-12 is like conventional waist bags in that it has a receiver 160 that has a body contacting wall 162 and a generally opposed and parallel non-body contacting wall 164 joined by right and left side walls 166 and 168, a top wall 170, and a bottom wall 172 that define an internal compartment 174. It will be understood that the term "body contacting" means "closest to the body of the bearer" and "non-body contacting" means "side furthest from the body of the bearer." It will be understood that in an alternative embodiment of the waist bag 150 the receiver 160 may be attached to a waist belt that completely encircles the bearer's waist, rather than the receiver forming a part of the waist belt. The receiver 160 in this version of the waist bag 150 would have a body contacting wall 162 that does not actually contact the body of the bearer when the waist bag 150 is rotated because the waist belt 180 would be between the bearer's body and the receiver 160.

The waist belt 180 has right and left wings 180*a* and 180*b*, respectively, attached to either side of the body contacting wall 162 of the receiver 160. The right and left wings preferably are padded, such as by forming a fabric-foam sheet-fabric sandwich, because they will fit over the iliac crests of the hips of the bearer. The right and left wings are attached to the webbing adjuster buckles 186*a* and 186*b*, which in turn are slidingly attached to the webbing straps 184. The buckle portions 182*a* and 182*b* are carried on the webbing straps 184. This is a known structure for providing a belt with two points for adjusting its circumference.

The internal compartment 174 of the receiver 160 is accessed via an opening at the juncture of the top wall 170, the body contacting wall 162, the right side wall 166, and the left side wall 168 that is reversibly secured by a zipper 176. When the zipper 176 is unsecured, the top side 170 of the receiver 160 will rotate away from the bearer 2 in the direction shown by the arrow 198, as shown in FIG. 4.

The receiver 160 is attached, such as by sewing, to the right and left wings 180*a* and 180*b* of the waist belt 180. In the configuration shown in FIGS. 10-12 the body contacting wall 162 is part of the waist belt 180.

The waist belt 180 is intended to be worn about the waist of the bearer 2 and is secured by the buckle 182, in the manner of a conventional waist belt. The buckle 182 shown in the drawings is a conventional side release design and comprises two releaseably mating components, a female portion 182*a* and a male portion 182*b*.

The bearer can move the receiver 160 of the waist bag 150 from the posterior to the anterior side of the bearer 2, and vice versa, by rotating the waist bag 150 by hand generally about the longitudinal axis (essentially the spine) of the bearer's body in the direction shown by the arrow 178 in FIG. 3. The bearer 2 may rotate the waist bag 150 by grasping one of the handles 188 and 190 that are attached adjacent the left and right ends, respectively, of the waist belt 180. The handle 192 mounted on the right side wall 166 of the receiver 160 (see FIG. 10) also is useful for this purpose and is most useful in withdrawing the receiver 160 from the lower compartment 100.

Loosening the waist belt 180 before rotation is recommended so as to reduce friction between the bearer's waist and the waist belt 180 during the rotation movement. The circumference of the waist belt 180 may be adjusted when the buckle 182 is closed, by moving the webbing 184 through the webbing adjuster buckles 186*a* and 186*b* so that the bearer can loosen or tighten the waist belt 180.

As shown in FIGS. 11 and 12, the body contacting wall 162 of the receiver 160 is concave. The body contacting wall 162 is therefore curved inward. It has been found that this inward curve allows easier egress and ingress of the receiver 160 with respect to the compartment 100. In addition, the receiver 160 fits more comfortably around the body of the bearer 2.

The bag portion 12 of the backpack 10 has openings in the right and left of the lower portion 14 that provide access to the compartment 100 from the outside of the bag portion 12 and vice-versa. These openings permit the waist bag 150 to rotate about the waist of the bearer and thus for the receiver 160 to exit and enter the compartment 100.

The lower end of the right side wall 40 comprises a side door 110 that can cover the opening 102 defined between the body contacting wall 20, the non-body contacting wall 30, the bottom wall 70, and the region of the right side wall 40 at and above the middle wall 90. The side door 110 permits the receiver 160 to enter and leave the lower compartment 100 through the opening 102 when it is opened and secures the receiver 160 inside the lower compartment 100 when it is closed.

A slot opening 52 is defined between the left side wall 50 and the body-contacting wall 20 in the vicinity of the lower compartment 100. The slot opening 52 is sized to permit the waist belt 180 (but not including the receiver 160), to pass through it.

It will be understand that the side door 110 is on the right side of the bag portion 12 because most bearers are right handed and will prefer to use their right hands to unfasten the side door 110 in order to withdraw the receiver 160 from the lower compartment 100. The side door 110 could just as well be located on the left side of the bag portion 12, for the convenience of left handed bearers.

The receiver 160 is sized and shaped to be received in the compartment 100 defined in the lower or inferior part 16 of the backpack 10. The receiver 160 passes through the opening 102 in the lower part 16. The lower part 16 is the part of the backpack 10 that is adjacent the bearer's lumbar region and waist.

FIG. 7 shows the body contacting side of the backpack 10. It will be noted that the distance between the slot opening 52 and the opening 102 defined in the lower part 16 of the backpack 10 is less than the normal width of the body contacting wall 20. This distance should be minimized if possible to permit easier rotation of the waist bag 150 around the waist of the bearer 2. It has been found empirically that the distance between the slot opening 52 and the opening 102 should be no greater than about 6.5 inches (about 16.5 centimeters). A greater distance will result in increased difficulty in removing the receiver 160 from the compartment 100 when the bearer 2 wears the backpack 10 and the waist bag is secured around the waist of the bearer 2. Likewise, ingress of the receiver 160 to the compartment 100 will be more difficult when the bearer 2 wears the backpack 10 and the waist bag is secured around the waist of the bearer 2. These difficulties are experienced because the receiver 160 engages the inner edges of the slot opening 52 and the opening 102 and the receiver 160 therefore has to rotate about and over those edges in order to egress and ingress the compartment 100. In that case, the bearer 2 may have to loosen the waist belt 180 and steer the receiver 160 out of and into the compartment 100. It is preferred to minimize the distance between the slot opening 52 and the opening 102 in order to facilitate the movement of the receiver 100 out of and into the compartment 100.

The body contacting wall 162, the non-body contacting wall 164, the top wall 170, and the bottom wall 172 preferably have dimensions that allow the receiver 160 to fit within the compartment 100 snugly enough to place the body contacting wall 162, the non-body contacting wall 164, the top wall 170, and the bottom wall 172 in proximate contact with, respectively, the body contacting wall 20, the non-body contacting wall 30, the middle wall 90, and the bottom wall 70 that form the compartment 100 of the lower part 16 of the bag portion 12.

As is shown in FIGS. 10 and 11, the receiver 160 is asymmetrically shaped. It tapers such that it is wider and higher on its right side as compared to its left side. This asymmetry has two purposes. The first purpose is to provide easier entry of the receiver 160 into the lower compartment 100. The left side of the receiver 160 is smaller than the opening 102 to the lower compartment 100 and therefore fits into it more readily. An advantage of this construction is that the walls of the backpack 12 defining the lower compartment 100, that is, the body contacting wall 20, the non-body contacting wall 30, the middle wall 90, and the bottom wall 70 that form the compartment 100 of the lower part 16 of the bag portion 12, need not be ultra rigid in order to maintain the shape of the lower compartment 100 so that the receiver 160 can be received in that compartment. In other words, these walls may have some flexibility. This means that the backpack 12 can be lighter and softer because stiffening materials such as polyethylene board are not necessary.

The second purpose is to provide a secure frictional reception of the receiver 160 in the lower compartment 100. The receiver 160, due to its asymmetry, is shaped like a plug filling a socket. The narrower or tapered end enters the opening first, followed by a wider end that fills the cavity of the plug and results in a secure frictional fit. The receiver 160 will be securely held in the lower compartment 100. It cannot exit through the slot opening 52 because it is too wide to go through the slot opening 52. Friction will tend to prevent it from leaving the lower compartment 100 unless the bearer 2 deliberately dislodges it. The door 110 and the buckle 194, discussed below, are used to conceal the receiver 160 when it is in the lower compartment 100 and give the backpack 10 the appearance of a normal backpack. They also provide assurance that the receiver 160 will not be dislodged from the lower compartment 100 in severe cases, such as when the backpack is not being worn on the back of the bearer and is severely handled, such as in the case of checked-in luggage.

The body contacting wall 162, the non-body contacting wall 164, the top wall 170, and the bottom wall 172 of the receiver 160 preferably have horizontal or left-to-right dimensions that generally correspond to those of the body contacting wall 20 and the non-body contacting wall 30 of the bag portion 12 of the backpack 10, although this is not required. These dimensions of the receiver could be smaller than those of the body contacting wall 20 and the non-body contacting wall 30 of the bag portion 12 of the backpack 10.

The right and left side walls 166 and 168 of the receiver 160 preferably are generally flush with the right and left sides of the compartment 100 when the receiver 160 is centered in the compartment 100. The receiver 160 then will fill up the compartment 100. In this configuration the carrying system 1 will appear to be a backpack to all but the most discriminating observer, especially when the door 100 is secured as described below. It also will be noted that in this configuration the receiver 160 will be supported by the backpack 10 with no wobbling or relative movement between the receiver 160 and the bag portion 12 of the backpack 10.

The internal structure of the preferred embodiment of an improved backpack and waist bag carrying system 1 is shown in the sectional view of FIG. 8. In general, the preferred embodiment of an improved backpack and waist bag carrying system 1 shown in the drawings is made of pieces of fabric and straps, buckles, foam padding, and stiffening sheet material sewn to each other. The body contacting wall 20 is shown to comprise a layer of foam padding that will provide some shape retention without too much rigidity.

The receiver 160 has a generally trapezoidal cross section, as shown in FIG. 8. The compartment 100 in the backpack 10 has a corresponding cross section. The receiver 160 is also tapered to narrow from right to left as shown in FIG. 11. This narrowing permits the receiver 160 to more easily enter the compartment 100, as mentioned, even if the walls of the compartment 100 are somewhat deformed.

The receiver 160 is retained in the compartment 100 partly by friction and also may be secured in the compartment 100 by the attachment of the door 110, preferably to the waist bag 150, by means of the buckle 194.

The type of buckle that is currently preferred for use as the buckle 194 is the self-locking two component slider magnetic buckle manufactured by Fidlock GmbH, a company based in Hannover, Germany. The manufacture, principle of operation, and use of this buckle is described in a published United States patent application, US 2011/0138583, filed by Joachim Fiedler and assigned to Fidlock GmbH. The disclosure of US 2011/0138583 is incorporated by reference as if fully set forth herein. The buckle 194 has a male buckle portion 194*a* and a female buckle portion 194*b*.

The male buckle portion 194*a* is secured to a stiffened piece of webbing 195 that is sewn to the lower right hand corner of the door 110. The female buckle portion 194*b* is attached to a piece of webbing (not shown) sewn to the body contacting wall 162 of the receiver 160. The female buckle portion 194*b* is secured by a housing 196 made of a piece of fabric sewn to the body contacting wall 162 of the receiver 160. The housing 196 prevents movement of the female buckle portion 194*b* with respect to the receiver 160 while its open end permits engagement of the female buckle portion 194*b* with the male buckle portion 194*a*. The male buckle portion 194*a* is attached at the end of the stiffened piece of webbing 195 in such a way as to bring the male buckle portion 194*a* directly to the female buckle portion 194*b* when the door 110 is shut (see, e.g., FIGS. 1 and 13). Movement of the female buckle portion 194*b* with respect to the receiver 160 is undesirable because it tends to make the mating of the buckle components 194*a* and 194*b* more difficult. The door 110 is designed to rotate up and in the direction indicated by the arrow 145 in FIGS. 3 4, and 14, and thus away from the opening 102 to the compartment 100, when the buckle portions 194*a* (attached to the door 110) and 194*b* (attached to the waist bag 150) of the buckle 194 are separated. This will permit the receiver 160 to be easily removed from the compartment 100 through the opening 102 and also allow the receiver 160 to be returned to the compartment 100 without the door obstructing its ingress through the opening 102.

The door 110 preferably is made of overlapped outer and inner layers 112 and 114, respectively. The overlapped outer and inner layers 112 and 114 preferably are made of a stretchy but durable fabric. Spandura®, a stretchy knit made of Lycra® (also known as spandex) elastic fiber and Cordura® nylon fiber, currently is preferred. (Spandura® is a trademark registered by H. Warshow & Sons, Inc. Cordura® and Lycra® are registered trademarks assigned to, and registered by, respectively, Invista North America S.a.r.l.)

The top side of the door 110 is sewn to the right side wall 40 and an upper portion of its left side is sewn to the non-body contacting wall 30. The outer layer of fabric 112 of the door 110 is secured to the inner layer of fabric 114 at their perimeters.

Figure 13:
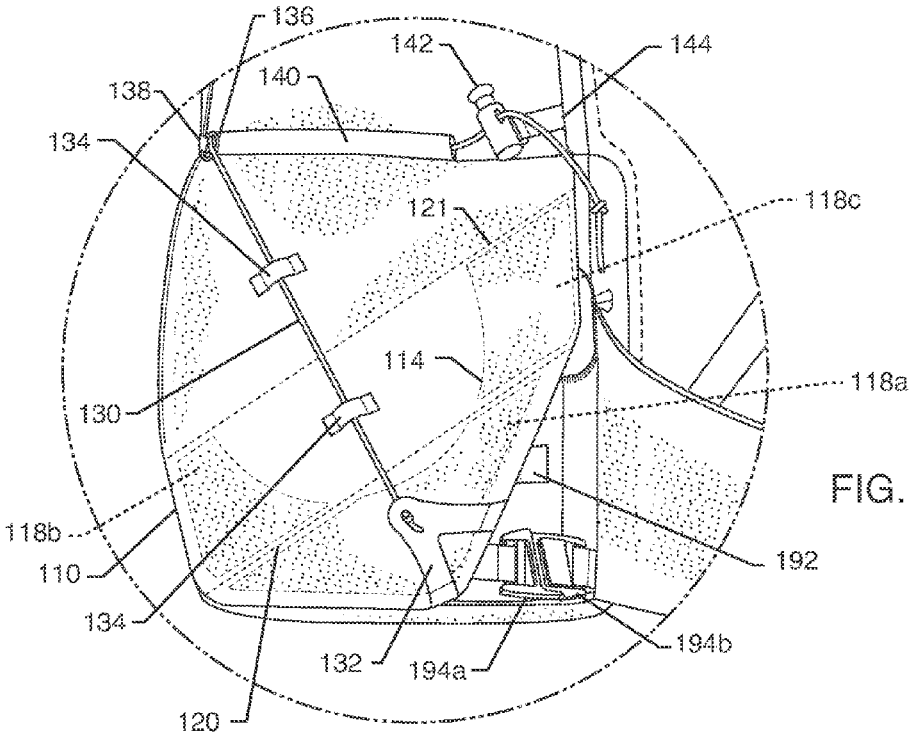
FIG. 13 is a perspective view of the portion of the right side of the first preferred embodiment of a backpack with waist bag carrying system in the first configuration in which the receiver of the waist bag is located inside the backpack, the portion being indicated in FIG. 1 by the phantom line circle 13.

The right and lower edges of the door 110 are reinforced by an L-shaped piece of foam sheeting strip 118 as shown in FIG. 13. The foam sheeting strip 118 reinforces the lower edge and the lower right-hand corner of the door 110, the latter region of the door being the part that supports the left-hand portion 194*a* of the buckle 194 as well as the anchor 132 of the tensioning system described below. The foam sheeting strip 118 also reinforces the lower left-hand edge of the door 110, up to the point where the left-hand edge of the door is sewn to the non-body contacting wall 30, and the upper right-hand edge of the door 110, up to where the upper right hand edge of the door 110 is sewn to the bottom of the right side wall 40. The reinforcing provided by the foam sheeting strip 118 resiliently stiffens those edges of the door 110 that can move because they are is not secured to any of the walls of the bag portion 12.

A tensioning system is provided to urge the door 110 away from the opening 102. An elastic cord 130 provides the tensioning force that rotates the door 110 in the direction shown by the arrow 145 in FIGS. 3 and 4. The elastic cord 130 is preferably is secured by the anchor 132 to the lower portion of the door 110 that contains the foam sheeting portion 118*a*. The anchor 132 preferably comprises a circular sewn bar-tack.

The elastic cord 130 passes through the guides 134 attached to the inner layer of fabric 114 to the ring guide 136 that is secured by the webbing tab 138 sewn to the bag portion 12 adjacent to the non-body contacting wall 30 (and preferably the middle wall 90). The elastic cord 130 then passes through the tunnel guide 142 formed by a flap of fabric running along the top of the upper portion 112.

The elastic cord 130 then passes through a toggle lock 142 that is attached to a webbing tab anchor sewn to the bag portion 12 adjacent the body contacting wall 20 (and preferably the middle wall 90). The bearer 2 may adjust the tension in the elastic cord 130 by moving the elastic cord 130 through the toggle lock 142 while squeezing the toggle lock 142.

Figure 14:
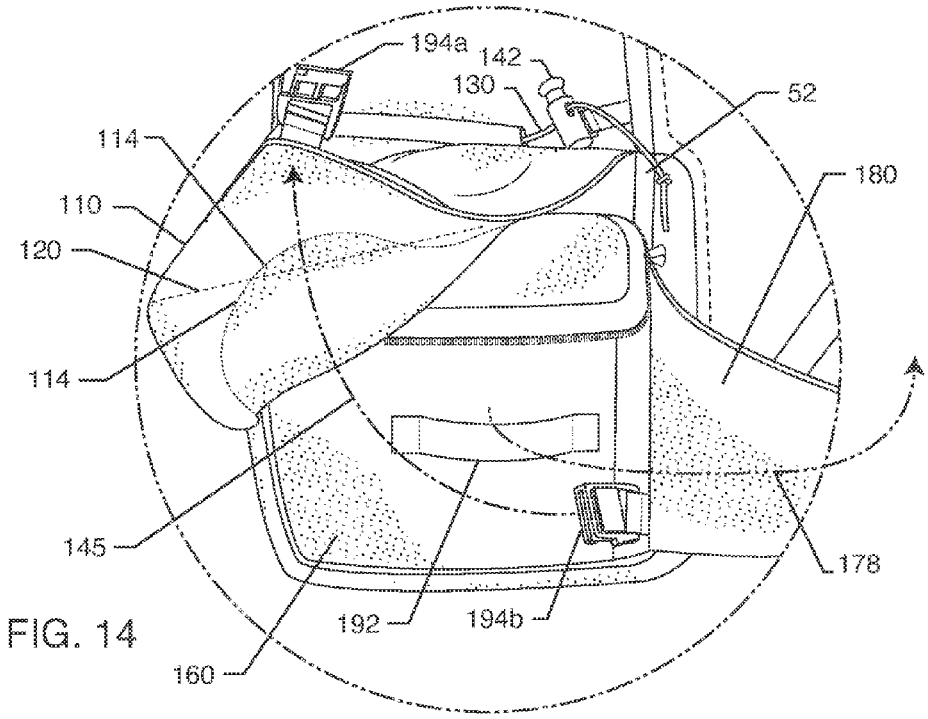
FIG. 14 is a perspective view of the portion of the right side of the first preferred embodiment of a backpack with waist bag carrying system shown in FIG. 13, however with the right hand door to the lower compartment retracted so that the receiver is visible.

It will be noted from a review of FIGS. 13 and 14 that the center of the door 110 meets the foam sheeting strip 118-reinforced edges of the door 110 along a curved line that is convex in the direction of the free edges of the door that are reinforced by the foam strip 118. The center of the door 110, being made of two layers of a stretchy material such as Spandura, permits the door 110 to deform out of the way to the receiver 160 when the receiver 160 is inserted into or removed from the compartment 100. It will be noted in FIG. 14 that the center of the door 110 meets the foam sheeting strip 118-reinforced edges of the door 110 along a curved line that is concave downwards in the direction of the center of the door 110 when the door 110 is folded up.

Therefore, once the door 110 is folded upwardly and to the left by the tensioning system after the bearer unfastens the two portions 194*a* and 194*b* of the buckle 194, the stretchy center of the door 110 primarily will contact the receiver 160 on its way in or out of the lower compartment 100. The structure of the door and tensioning system described in this specification allows the bearer to rapidly access the receiver 160 while wearing the backpack 10 with the receiver 160 in the lower compartment 100. All the bearer has to do is slide the two portions of the buckle 194 apart and then remove the receiver 160 out of the compartment 100 by pulling out on one of the handles 192 or 190. The bearer 2 then continues of the movement of the receiver 160 around his or her waist preferably by pulling on the handle 192 until the receiver 160 is adjacent the front of his or her torso.

Once the bearer 2 wants to return the receiver 160 to the lower compartment 100, all he or she has to do is make sure the top wall 170 of the receiver 160 is folded back onto the rest of the receiver 160 (preferably zipped shut using the zipper 176, although this is not necessary). He or she can then grasp the handle 192 (or, initially, the handle 188) and pull the receiver 160 back around his or her torso toward the opening 102 of the lower compartment 100. He or she may then push the receiver 160 through the center 116 of the retracted door 110 or pull on the handle 188 to continue the rotation of the waist bag 150 around his or her waist, which will also cause the receiver 160 to slide past the center of the door 110. The receiver 160 will then be safely lodged in the lower compartment 100.

The bearer 2 then may connect the two portions 194*a* and 194*b* of the buckle 194 to each other to secure the lower right-hand corner of the door 110 to the waist bag 150. In the preferred embodiment shown in the drawings, this action is assisted by the magnetic attraction of the two portions 194*a* and 194*b* of the Fidlock slider buckle for each other. Non-magnetic buckles, if used in place of the Fidlock buckle, will require the bearer to mate the two portions by inserting one portion into the other. For this reason, it is desirable to have the female portion of such a buckle mounted either on the waist belt 180 or the receiver 160 in such a way that it will not move very much.

Because of the snug fit of the asymmetric receiver 160 in the lower compartment 100 (like a plug in a socket) the receiver 160 will remain in the lower compartment 100 even with the door 110 unfastened and can be worn that way. Fastening the buckle 194 provides extra assurance that the receiver 160 will remain in the lower compartment 100, especially when the waist belt 180 is not fastened around the waist of the bearer 2 by connecting the buckle portions 182*a* and 182*b*. It is also desirable to fasten the buckle 194 when the backpack 10 is being carried by hand and the upper compartment is not so full as to exert pressure on the receiver 160 in the lower compartment.

Experience has shown that the receiver 160 can emerge unbidden from the compartment 100 when the waist belt 180 is unbuckled and the door 110 is not fastened to the receiver 160. In that condition, if the receiver 160 contains heavy gear such as a telephoto lens and the backpack 10 is lifted from the ground by the left shoulder strap 82, the backpack 10 could be so tilted that the receiver 160 could slide out of the compartment 100. For this reason it is advisable to remind the bearer to keep the door 110 fastened to the receiver 160 when the receiver 160 is in the compartment 100. Likewise, the belt buckle 182 of the waist belt 180 should be secured whenever possible because this will prevent separation of the waist bag 150 from the backpack 10 even if the receiver 160 slips out of the compartment 100.

As a further security measure, a tether system 120 is provided for assuring that the receiver 160 cannot fall too far from the backpack 10. The tether system 120 provides a tether 122 that joins the receiver 160 to the backpack 10. The tether 122 may be a piece of webbing or a cord. The tether 122 is secured to a tether anchor 121 that is sewn to the backpack 10 on its right side wall 40 and to a tether anchor 124 sewn to the receiver 160 on its left side wall.

The tether 122 slides into the compartment 100 with the receiver 160 when the receiver 160 is secured in the compartment 100, as shown in FIG. 1. The tether 122 will not be very visible from outside the backpack 10. The tether 122 will follow the receiver 160 when the receiver 160 is removed from the compartment 100. The waist bag 150 cannot fall far from the backpack 10 even when the waist belt is unsecured around the waist of the bearer 2, thanks to the tether system 120.

With the receiver 160 inside the lower compartment 100 and the door 110 attached to the waist bag 150 by fastening the buckle 194, the combination of the backpack 10 and the waist bag 150 will appear to be an ordinary backpack with a waist belt. Nothing about the appearance of the combination of the backpack 10 and the waist bag 150 is likely to give the impression of a specialized or unusual carrying bag. It will appear to be a conventional backpack until the bearer 2 decides to access the receiver 160 while wearing the backpack 10 on his or her back. An innocuous look is important, for example, to photographers covering events in difficult and dangerous areas of the world, where the photographer will not want to give the obvious appearance of being a person who carries expensive cameras and lenses. At the same time, the photographer will have his or her camera available in seconds if the camera is in the receiver 160.

An additional benefit is that the bearer may carry a camera or other gear (such as binoculars) safely in the backpack 12 on his or her back yet has this equipment available as soon as needed without taking off the backpack 12. The bearer does not need to carry the camera or other gear in a holster (or attached to a strap) at his or her waist or on his or her chest where this equipment might be distracting or in the way, such as when climbing or rappelling.

A second preferred embodiment of a backpack with waist bag carrying system according to the invention is indicated generally by reference numeral 200 in FIGS. 15-21. This embodiment of a backpack with waist bag carrying system 200 provides a backpack 210 operatively connected to a waist bag 250.

The backpack 210 is of a generally conventional design and has a bag portion 212 attached to shoulder straps 244. The bag portion 212 comprises a body contacting wall 222 connected to a right side wall 226, a left side wall 232, a top wall 240, and a bottom wall 242, and a non-body contacting wall 224 connected to the right side wall 226, left side wall 232, top wall 240, and bottom wall 242. The walls comprising the bag portion 212 define an upper compartment 218 and a lower compartment 220. The upper compartment 218 and a lower compartment 220 are separated by a middle wall as in the backpack with waist bag carrying system 1 of the first preferred embodiment described above.

Access to the upper compartment 218 in the bag portion 212 of the backpack 210 is by means of an opening in the right side wall 226, the top wall 240, and the left side wall 232 that is secured by a zipper 219. Access to the lower compartment 220 is provided by a right side door 228 and a left side door 234 that secure right and left side openings in the bag portion 212. The right side door 228 is formed in the body contacting wall 222 and the right side wall 226 and is secured by a zipper 230. The left side door 234 is formed in the body contacting wall 222 and the left right side wall 232 and is secured by a zipper 236.

Figure 17:
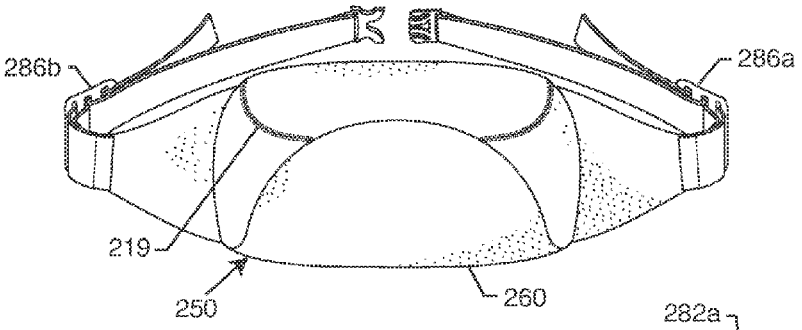
FIG. 17 is a perspective view of the front side of the waist bag of the second preferred embodiment of a backpack with waist bag carrying system, the waist bag being shown separately from the backpack portion.
Figure 18:
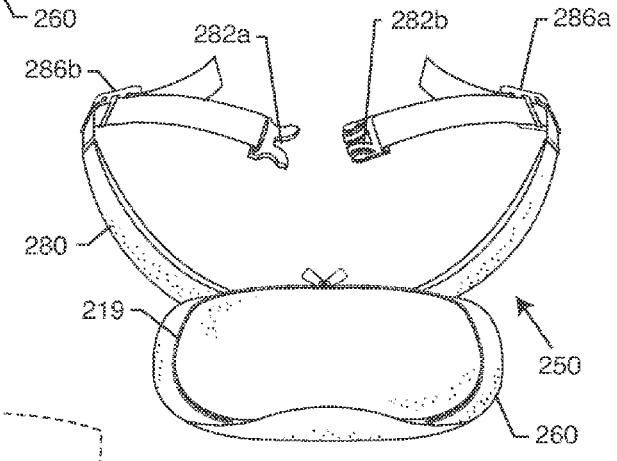
FIG. 18 is a perspective view of the top side of the waist bag of the second preferred embodiment of a backpack with waist bag carrying system, the waist bag being shown separately from the backpack portion.

The waist bag 250 is shown by itself in FIGS. 17 and 18. It comprises a receiver 260 connected to a waist belt 280. It will be understood that the receiver 260 could be formed as part of the waist belt 280 as in the first preferred embodiment discussed above. The receiver 260 comprises walls that define a compartment accessed by an opening secured by a zipper and is comparable in that respect to the receiver 160 of the waist belt 150 of the first preferred embodiment, including being concave inward on the body contacting side (see FIG. 18). The waist belt 280 is similar to the waist belt 180 of the first preferred embodiment, and comprises has female locking buckle portion 282*a* attached by webbing to the left webbing adjuster buckle 286*b* and male locking buckle portion 282*b* attached by webbing to the right webbing adjuster 286*a*. It will be understood that the locking buckle portions 282*a* and 282*b* could switch positions with each other. The left and right webbing adjuster buckles 286*b* and 286*a* are in turn attached to the ends of the main part of the waist belt 280 to which the receiver 260 is attached.

The receiver 260 is rounded at its right and left ends, as shown in FIGS. 17 and 18, in order to permit the receiver 260 to easily enter the lower compartment 220 when the waist bag is worn by the bearer 201 and the bearer 201 rotates the waist bag 250 in order to return the receiver 260 into the lower compartment 220.

Figure 15:
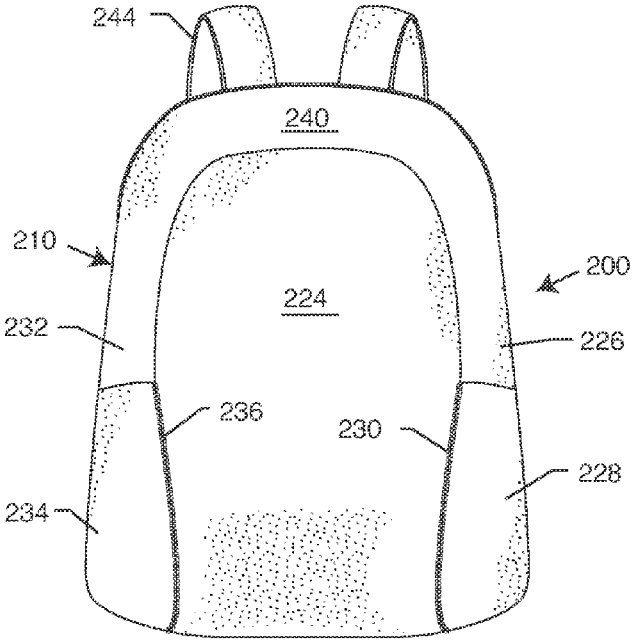
FIG. 15 is a perspective view of the front or non-body contacting side of a second preferred embodiment of a backpack with waist bag carrying system in a first configuration in which the waist bag is contained inside the backpack.
Figure 16:
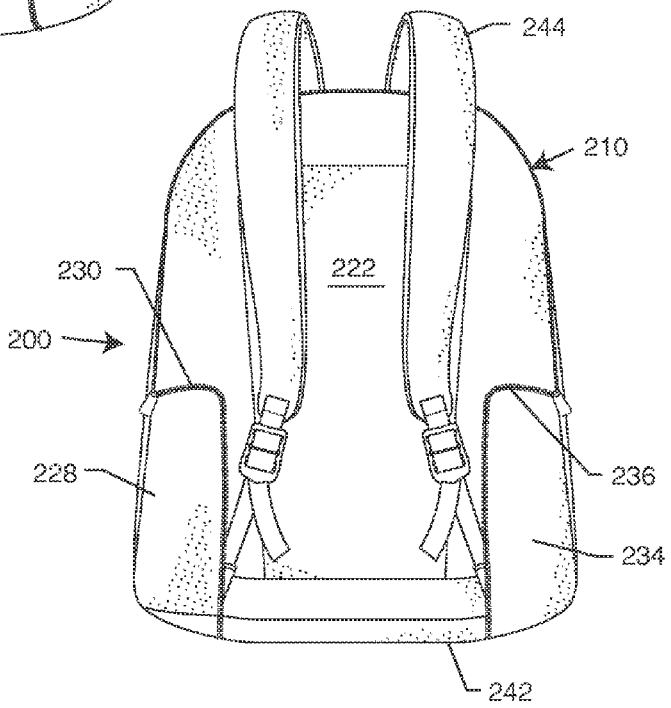
FIG. 16 is a perspective view of the body contacting side of the second preferred embodiment of a backpack with waist bag carrying system in the first configuration in which the waist bag is contained inside the backpack.
Figure 19:
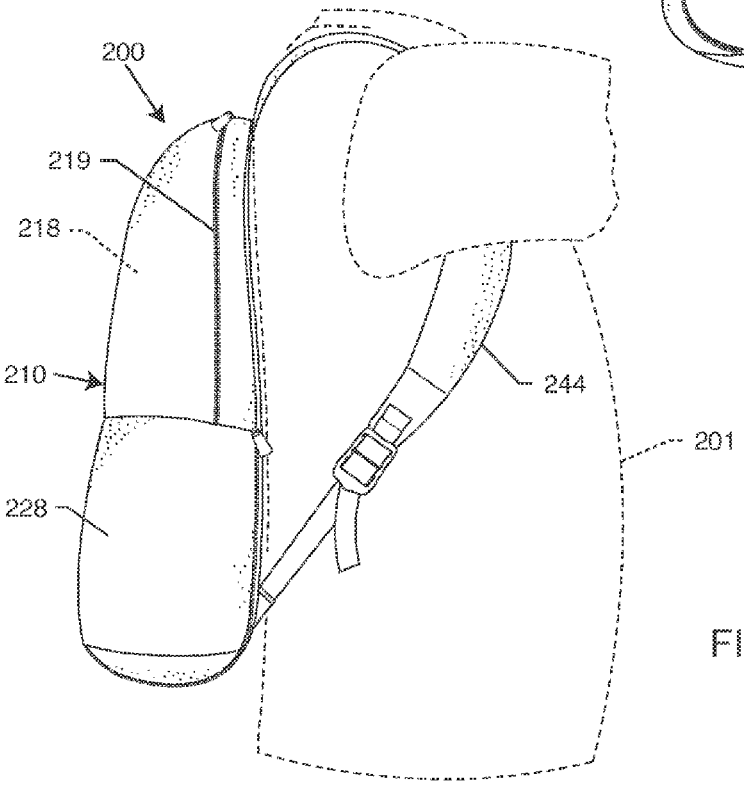
FIG. 19 is a perspective view from the right side of the second preferred embodiment of a backpack with waist bag carrying system shown being worn by a human being or bearer in the first configuration in which the waist bag is deployed inside the backpack.

In FIGS. 15, 16, and 19 the right side door 228 and the left side door 234 are secured by their respective zippers 230 and 236 to close any access to the lower compartment 220. The backpack 210 will appear to be merely a backpack without a waist belt.

Figure 20:
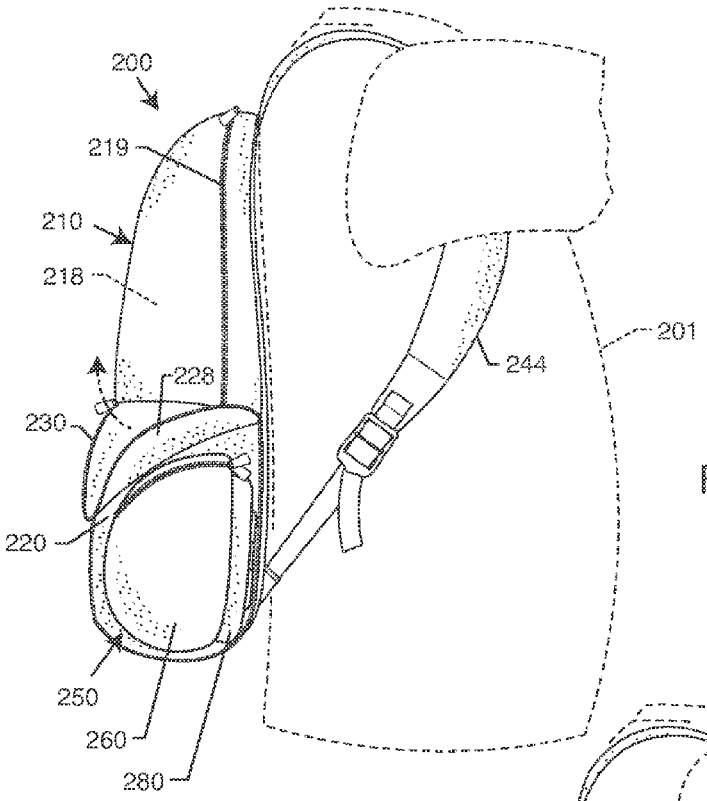
FIG. 20 is a perspective view from the right side of the second preferred embodiment of a backpack with waist bag carrying system shown being worn by a human being or bearer in the first configuration in which the waist bag is contained inside the backpack but is visible through the opened door.

In FIG. 20 the right side door 228 has been opened by unzipping the zipper 230, revealing the lower compartment 220, which contains the waist bag 250. The waist belt 280 is folded between the receiver 260 and the body contacting wall 222. The bearer 201 may unzip the zipper 230 while wearing the bag portion 212 on his back by simply reaching back with his right hand and tugging on the zipper pull of the zipper 236.

Likewise, the bearer 201 may unzip the left side door 234 with his or her left hand while wearing the bag portion 212 on his back. The bearer 201 may then reach into the compartment 220 with his or her right hand and pull out the right portion 280*a* of the waist belt. This can be done while the bearer 201 is wearing the bag portion 212 on his or her back. Likewise, he or she may reach into the compartment 220 left hand pull out the left portion 280*b* of the waist belt. He or she then may join the buckle portions 282*a* and 282*b* in order to secure the ends of the waist belt 280 to each other so the waist belt surrounds his or her torso.

Figure 21:
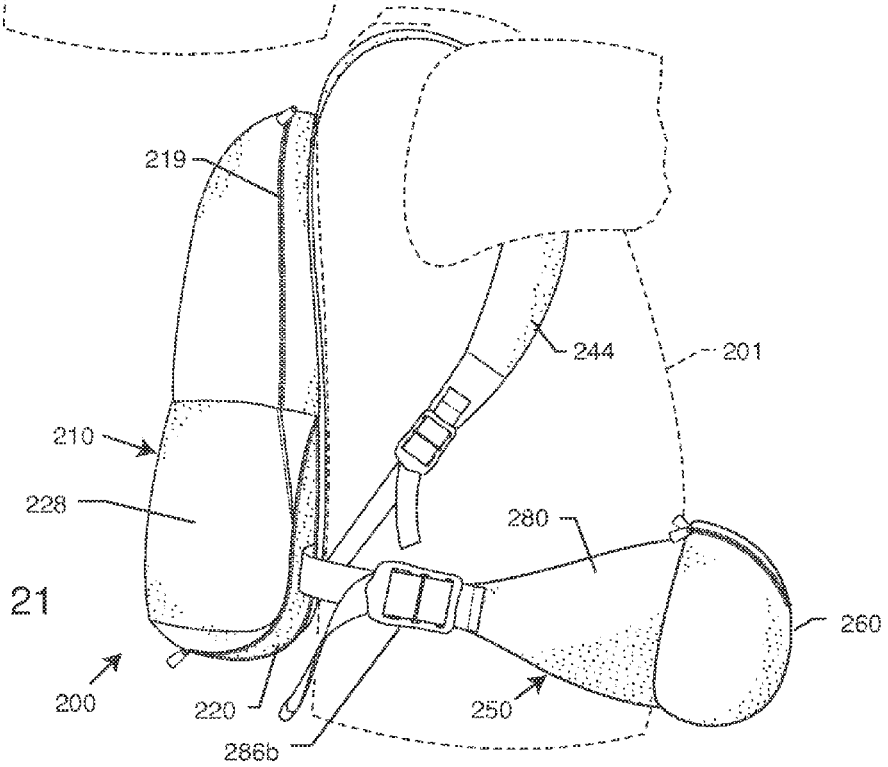
FIG. 21 is a perspective view from the right side of the second preferred embodiment of a backpack with waist bag carrying system in a second configuration in which the waist bag encircles the bearer's waist and the receiver of the waist bag is deployed in front of or on the anterior side of the bearer.

In FIG. 21 the waist bag 250 has been rotated in order to deploy it into a configuration that will permit the bearer 201 to access the contents of the receiver 260.

The bearer 201 may then zip the zipper pulls of the zippers 230 and 236 to close the left and right side doors 228 and 234, respectively. The bearer 201 will not be able to completely close the zippers 230 and 236 because the deployed waist belt 280 will prevent closing in the vicinity of the body contacting wall 222 of the bag portion 212. It is preferable for the zippers 230 and 236 to be arranged to open when zipped from where they terminate on the body contacting wall 222 to their other ends (move the zipper slider away from the bearer 201) and close when zipped toward the body contacting wall 222 (move the zipper slider toward the bearer 201).

Once the zippers 230 and 236 are closed up to the deployed waist belt 280 and the doors 228 and 234 are secured over the openings to the lower compartment 220, an observer will likely conclude that the backpack 210 in this configuration is an ordinary backpack with a waist belt. A more detailed examination would be required to determine that the backpack 210 has the rotating waist bag feature.

The second preferred embodiment of a backpack with waist bag carrying system could be modified by replacing one of the side doors with a slot opening, as in the first preferred embodiment.

Figure 22:
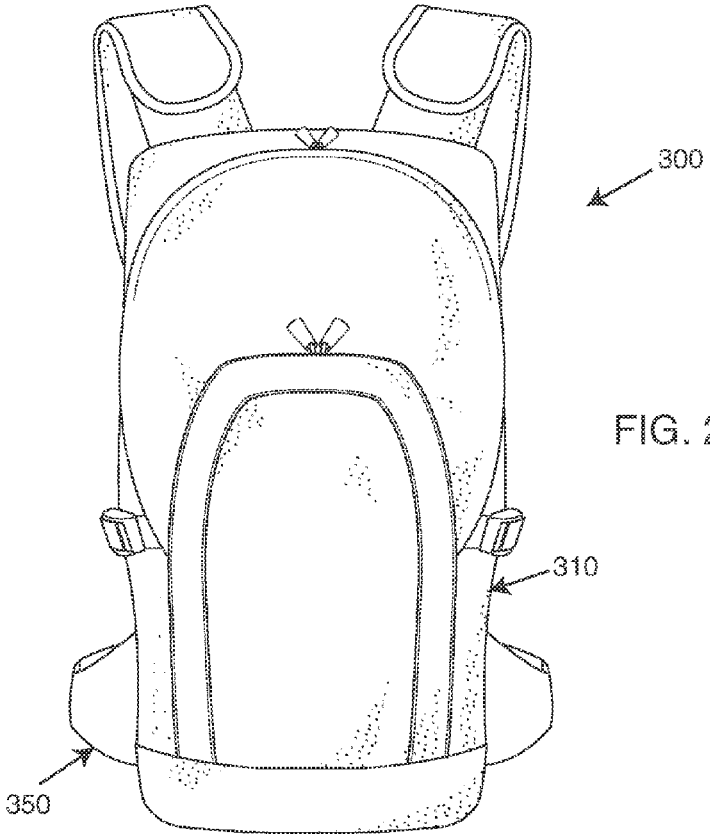
FIG. 22 is a perspective view of the front or non-body contacting side of a third preferred embodiment of a backpack with waist bag carrying system in which the receiver of the waist bag is contained within the backpack.
Figure 23:
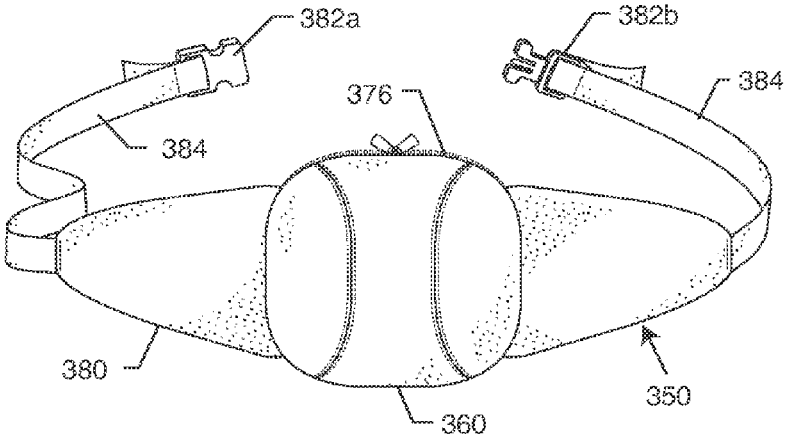
FIG. 23 is a perspective view of the front side of the waist bag of the third preferred embodiment of a backpack with waist bag carrying system.
Figure 24:
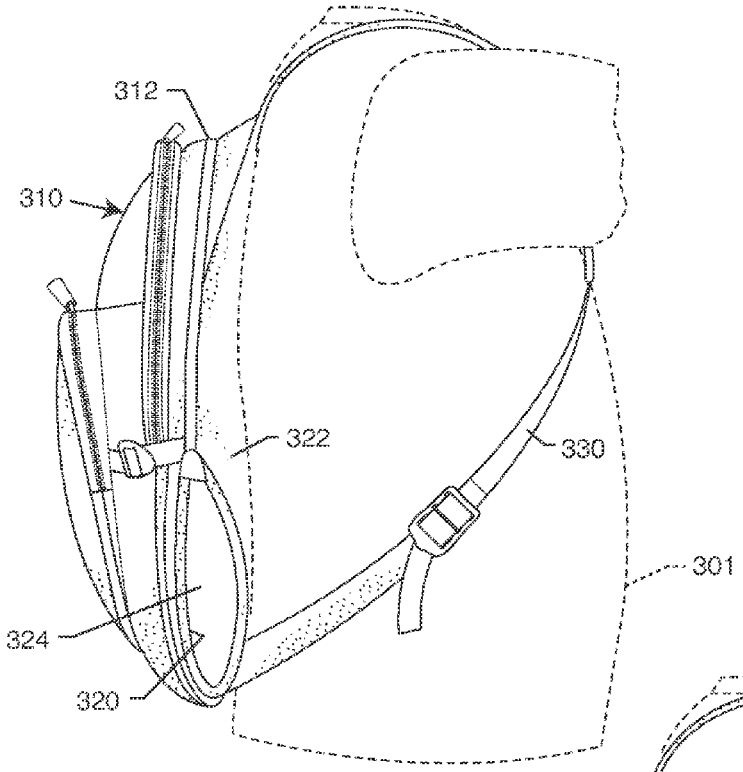
FIG. 24 is a perspective view from the right side of the backpack portion of the third preferred embodiment of a backpack with waist bag carrying system shown being worn by a human being or bearer, the waist bag having been removed from the backpack portion.
Figure 25:
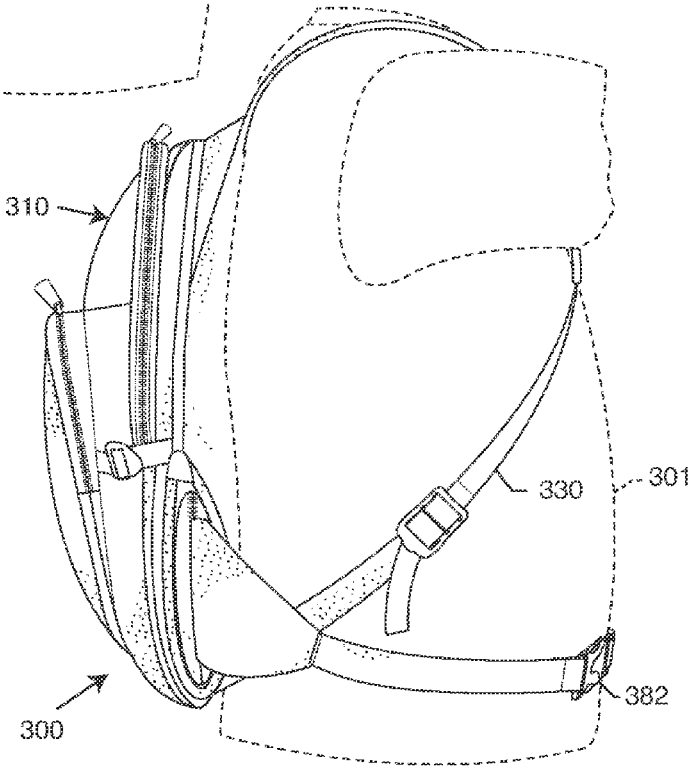
FIG. 25 is a perspective view from the right side of the third preferred embodiment of a backpack with waist bag carrying system in which the receiver of the waist bag encircles the bearer's waist and the receiver of the waist bag is contained within the backpack.

A third preferred embodiment of a backpack with waist bag carrying system 300 is shown in FIGS. 22-25. A backpack 310 comprises a bag portion 312 attached to shoulder straps 330. The bag portion 312 comprises walls defining one or more compartments for holding articles. In FIGS. 22, 24, and 25 the backpack 310 is shown in the form of a small backpack of the kind used by runners, bicyclists, and trail hikers to carry a hydration system, but this is not required.

Referring to FIGS. 24 and 25, the backpack 310 has a body contacting wall 322 that is spaced from the lower part of the inside wall 320 of the bag portion 312. The lower portion of the body contacting wall 322 does not border any compartment defined in the bag portion 312 as in the first and second preferred embodiments. Rather, it defines a compartment 324 between itself and the inside wall 320 of the bag portion 312. The compartment 324 is open to the right and left to accommodate the waist bag 350.

FIG. 23 shows the waist bag 350. The waist bag 350 comprises a receiver 360 attached to a waist belt 380. The receiver 360 comprises walls that define a compartment accessed by an opening secured by a zipper and is comparable in that respect to the receiver 160 of the waist belt 150 of the first preferred embodiment and the receiver 260 of the waist belt 250 of the second preferred embodiment. The waist belt 380 is shown to be similar to the waist belt 280 of the second preferred embodiment. It will be understood that the receiver 360 of the waist bag 350 may be part of the waist belt 380 as in the case of the first preferred embodiment.

The waist bag 350 as shown in FIG. 25 is deployed about the torso of the bearer 301 with the receiver 360 contained in the compartment 324. In this configuration, an observer is likely to consider the combination of the backpack 310 and the waist bag 350 to be an ordinary backpack with a waist belt. In a second configuration, the bearer 301 may rotate the waist belt 380 about his torso, in either direction, to bring the receiver 360 to his or her front for accessing the contents of the receiver 360.

The receiver 360 is rounded at its right and left ends in order to permit the receiver 360 to easily enter the lower compartment 324 when the bearer 301 rotates the waist bag 350. The bearer 301 rotates the waist bag 350 in order to return the receiver 360 into the compartment 324.

The backpack with waist bag carrying system 300 is believed to work best if it is light in weight when loaded and the receiver is relatively thin. A heavy backpack 310 will tend to press against the back of the bearer's torso which will make the insertion of the receiver 360 into the compartment 324 more difficult when the backpack 310 is worn on the bearer's back unless the lower body contacting wall 322 is made more rigid, such as by adding a stiffening element such as polyethylene (PE) board. A thick receiver will tend to push the bag portion 312 away from the torso of the bearer 301 and might be awkward.

Figure 26:
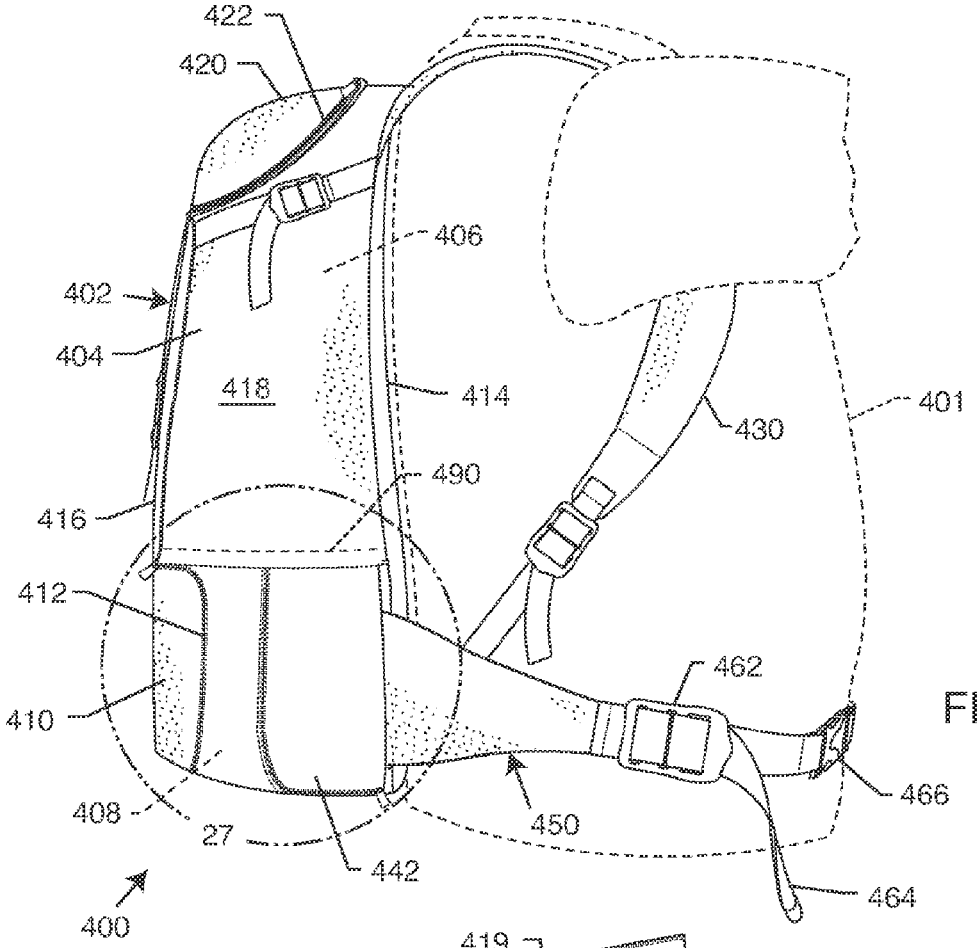
FIG. 26 is a perspective view from the right side of a fourth preferred embodiment of a backpack with waist bag carrying system shown being worn by a human being or bearer in a first configuration in which the waist bag encircles the bearer's waist and the receiver of the waist bag is contained inside the backpack.
Figure 27:
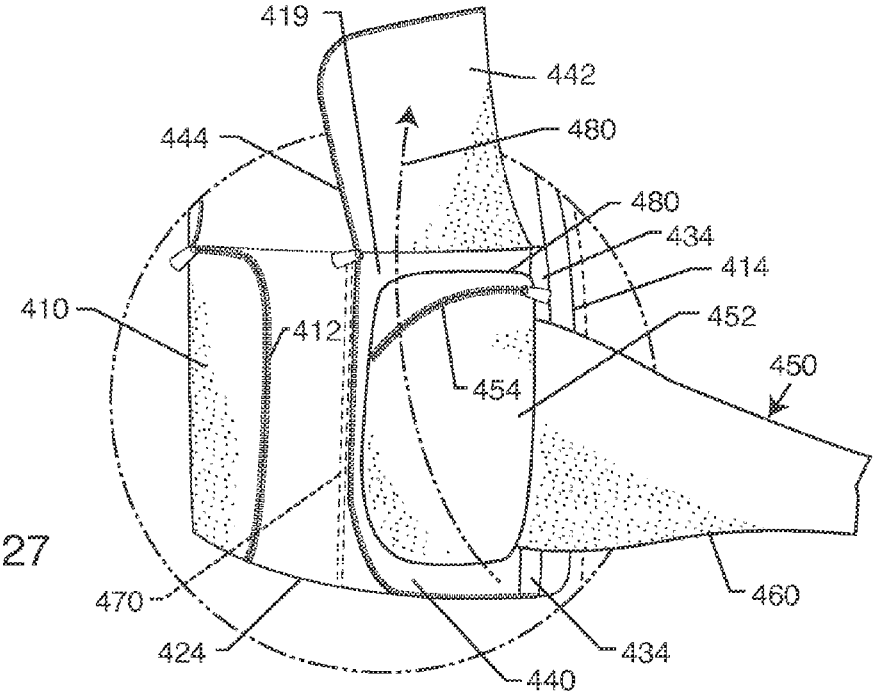
FIG. 27 is a perspective view of a portion of the right side of the fourth preferred embodiment of a backpack with waist bag carrying system indicated by the phantom line circle 27 in FIG. 26, showing the door securing the lower and inside compartment to be opened and showing the receiver contained in that compartment.

A fourth preferred embodiment of a backpack with waist bag carrying system 400 is shown in FIGS. 26-27. This embodiment is similar to that of the first preferred embodiment 1 but provides a compartment within the backpack's bag portion that does not occupy the entire lower part of the bag portion.

The backpack with waist bag carrying system 400 comprises a backpack 402 and a waist bag 450. The backpack 402 comprises a bag portion 404 joined to shoulder straps (a right shoulder strap 430 is shown in FIG. 26).

The bag portion 404 comprises a body contacting wall 414 and an opposed non-body contacting wall 416 that are joined by a right side wall 418, a left side wall 419, a top wall 420, and a bottom wall 424. The top wall 420, the body contacting side 414, the non-body contacting wall 416, the right and left side walls 418 and 419, and a middle wall 490 define an upper compartment 406. The middle wall 490 is similar to the middle wall 90 of the backpack 10 of the first preferred embodiment. The upper compartment 406 is accessed through an opening secured by a zipper 422.

The bottom wall 424, the body contacting wall 414, the non-body contacting wall 416, the middle wall 490, the right side wall 418, and the left side wall 419 define an outer lower compartment 408 and an inner lower compartment 440. A vertical divider wall 470 separates the outer lower compartment 408 and the inner lower compartment 440. The inner lower compartment 440 is adjacent the body contacting wall 414 and the outer lower compartment 408 is adjacent to the non-body contacting wall 416.

An opening is defined in the right side wall 418, the non-body contacting wall 416, and the left side wall 419. A zipper 412 secures this opening. Unzipping the zipper 412 causes a flap 410 formed from the right side wall 418, the non-body contacting wall 416, and the left side wall 419 to hinge away from the bag portion 404 to permit access to the outer lower compartment 408.

The inner lower compartment 440 is accessed through an opening defined in the right side wall 418 that is provided with a door 442 that is an extension of the right side wall 418. The door 442 is a flap that is secured to an adjacent part of the right side wall 418 and to the bottom wall 422 by a zipper 444. The door 442 may be rotated in the direction indicated by the arrow 480 when the slider of the zipper 444 is moved to free the door 442 to uncover the opening to the inner lower compartment 440.

A slot opening 434 provides another entrance to the inner lower compartment 440. The slot opening 434 is defined between the left side wall 419 and the body contacting wall 414.

The waist bag 450 comprises a receiver 452 having walls defining a compartment that is accessed through an opening secured by a zipper 454. The receiver 452 is attached to a waist belt 460 that is secured around the torso of the bearer 401 by the locking buckle 466 and having a webbing adjuster buckle 462 to adjust its circumference. The waist bag 450 shown in FIGS. 26 and 27 is similar to the waist bags of the previous preferred embodiments.

The waist bag 450 is operatively connected to the backpack 402 by extending through the inner lower compartment 440 when the waist bag 450 is fastened about the torso of the bearer 401. The receiver 452 is sized to be received within the inner lower compartment 440 in the configuration seen in FIGS. 26 and 27. The receiver 452 also is rounded to facilitate entry of the receiver 452 into the inner lower compartment 440.

As in the previous preferred embodiments, the waist bag 450 may be rotated around the torso of the bearer 401 to bring the receiver 452 to the front of the bearer 401 in one configuration to permit the bearer 401 to access the contents of the receiver 452, and then returned to the inner lower compartment 440 in the configuration shown in FIGS. 26 and 27.

Because the slot 434 will not permit passage of the receiver 452, the waist bag may not be rotated in either direction to remove it from the inner lower compartment 440. The door 442 could be placed on the left side of the bag portion 404 and the slot 434 on the right side if desired. Alternatively, two doors might be provided as in the backpack with waist bag carrying system 200 of the second preferred embodiment. Furthermore, the door 442 could be formed with a tensioning system in the manner of the door 110 of the first preferred embodiment.

The backpack with waist bag carrying system 400 will resemble an ordinary backpack with a waist belt when in the configuration in which the receiver 450 is secured inside the inner lower compartment 440.

A fifth preferred embodiment of a backpack with waist bag carrying system 500 is shown in FIGS. 28-32. This embodiment provides a compartment for containing the receiver of a waist bag. That compartment is within the backpack's bag portion but does not occupy the entire lower part of the bag portion of the backpack. This embodiment provides reinforcing for that compartment so the compartment remains open despite pressure from the back of the bearer 501 and from the weight of articles contained in other compartments in the backpack's bag portion. Other differences include the omission of doors for the compartment meant to receive the waist bag, the provision of a buckle for securing the receiver of the waist bag in that compartment, an additional chamber in the bag portion of the backpack that extends the height of the bag portion, and the provision of pouches on the waist bag that may be accessed when the receiver is contained in its compartment in the bag portion of the backpack.

Figure 28:
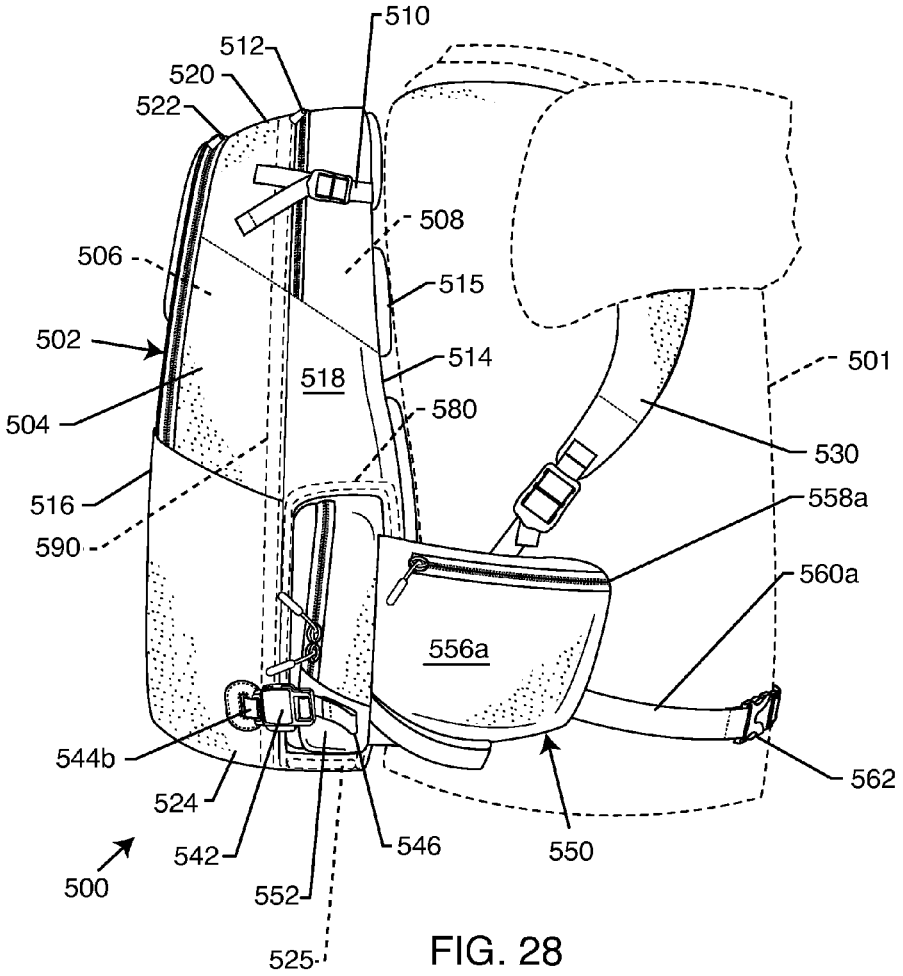
FIG. 28 is a perspective view from the right side of a fifth preferred embodiment of a backpack with waist bag carrying system shown being worn by a human being or bearer in a first configuration in which the waist bag encircles the bearer's waist and the receiver of the waist bag is contained inside the backpack.
Figure 29:
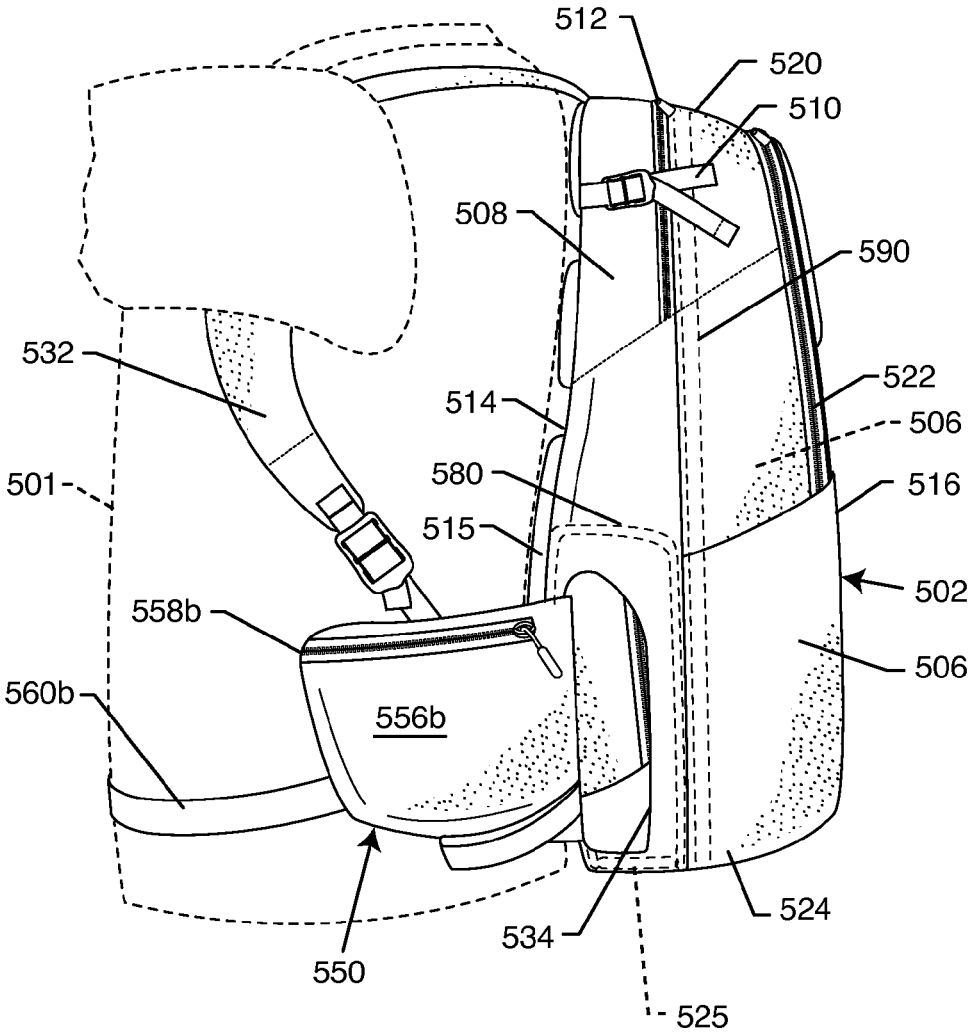
FIG. 29 is a perspective view from the left side of the fifth preferred embodiment of a backpack with waist bag carrying system shown being worn by a human being or bearer in a first configuration in which the waist bag encircles the bearer's waist and the receiver of the waist bag is contained inside the backpack.
Figure 30:
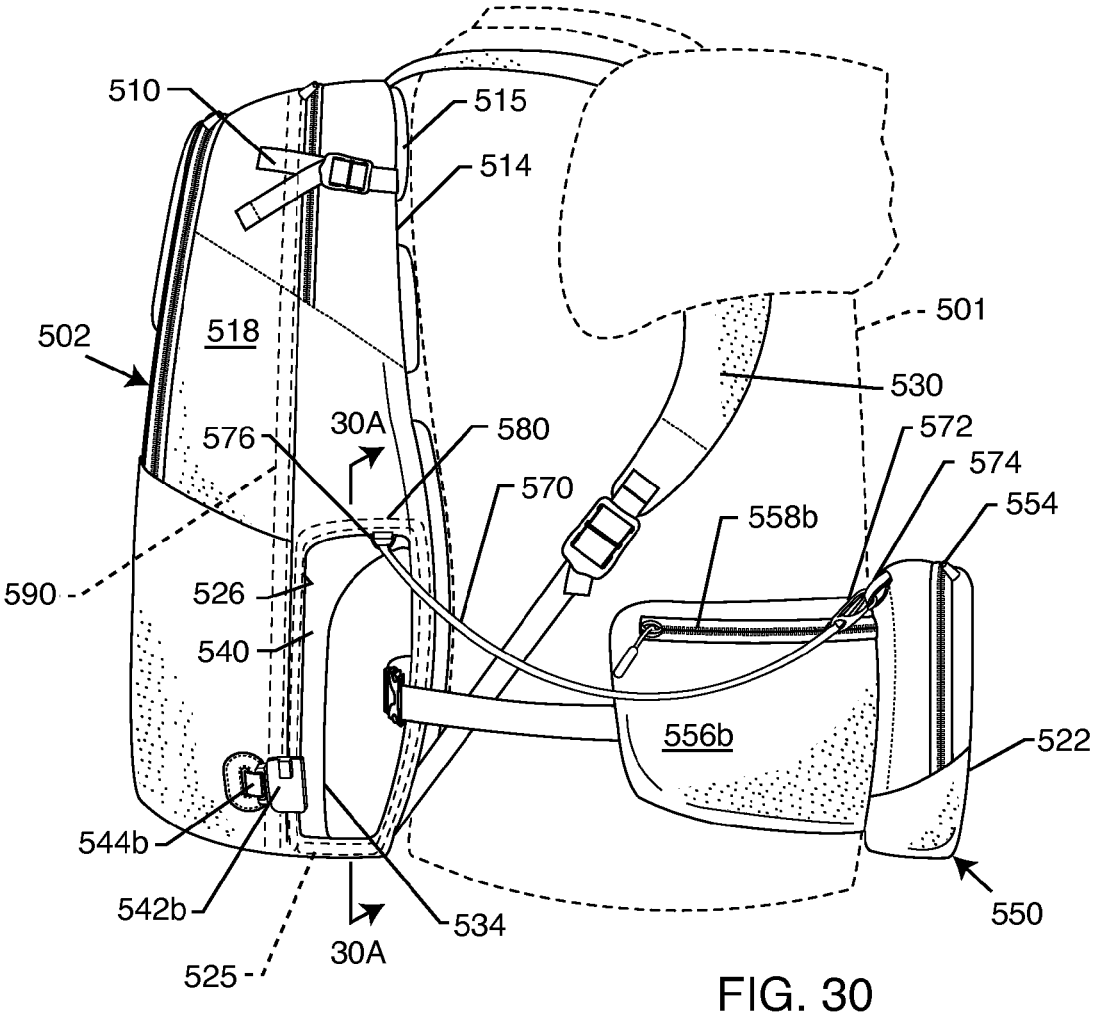
FIG. 30 is a perspective view from the right side of the fifth preferred embodiment of a backpack with waist bag carrying system shown being worn by a human being or bearer in a second configuration in which the waist bag encircles the bearer's waist and the receiver of the waist bag is deployed to the front side of the bearer.

The backpack with waist bag carrying system 500 comprises a backpack 502 and a waist bag 550. The backpack 502 comprises a bag portion 504 joined to shoulder straps 530 and 532. A right shoulder strap 530 is shown in FIGS. 28 and 30 and a left shoulder strap 532 is shown in FIG. 29.

The bag portion 504 comprises a body contacting wall 514 and an opposed non-body contacting wall 516 that are joined by a right side wall 518, a left side wall 519, a top wall 520, and a bottom wall 524. The body contacting wall 514, the non-body contacting wall 516, the right side wall 518, the left side wall 519, the top wall 520, and the bottom wall 524 preferably are made of a suitable fabric such as nylon fabric having a denier chosen to provide a good balance of strength and weight. In addition, these walls may be lined with closed cell foam or open cell foam to provide shaping to the bag portion 504 and protection to articles contained in compartments in the bag portion 504.

The body contacting wall 514 preferably has components in addition to fabric to provide shape and to pad the body contacting wall 514 for contact with the bearer 501's body. A polyethylene board (not shown) shaped to fit the bearer 501's back is inserted under the fabric of the body contacting wall 514. The side of the polyethylene board facing away from the bearer is attached to an aluminum alloy vertical stay to lend additional support and rigidity to the bag portion 504 and the side of the polyethylene board that will contact the bearer 501 is lined with open cell foam. In addition, the body contacting wall 514 is provided with three padded areas or bumpers 514 that are made of open cell foam covered by a mesh fabric. The spaces between the bumpers 514 provide channels between the body contacting wall 514 and the back of the bearer 501 for cooling the back of the bearer. It will be understood that the structure of the body contacting wall 514 described here may be varied according to ways known to the art.

The top wall 520, the bottom wall 524, the non-body contacting wall 516, the right and left side walls 518 and 519, and a vertical interior divider wall 590 define a first internal compartment 506 that essentially extends the height of the bag portion 504. The interior divider wall 490 preferably extends between the top of the non-body contacting wall 516 and the bottom wall 524. (It will be understood that the backpack 502 might have an opening covered by a floating lid pocket instead of a top wall 520, and therefore the top wall 520 might not exist as such, and that the first internal compartment 506 may not have a height that is comparable to the height of the bag portion 504.) An opening preferably is formed at the juncture of the right side wall 518, the top wall 520, and the left side wall 519. This opening provides access to the first internal compartment 506 and is secured by a zipper 522. The first internal compartment 506 preferably will be long enough in the vertical dimension to carry long articles such as a laptop computer (not shown). In order to protect such a computer from damage the interior divider wall 590 preferably contains a sheet of closed cell foam. A pocket (not shown) comprising closed cell foam enclosed in fabric may be provided inside the internal compartment 506 to further protect the computer. The pocket could be attached to the interior divider wall 590 with an opening at its top to receive the computer. The design of such a pocket is conventional and known to the art. It will be understood that the terms "vertical," "vertically," "horizontal," "horizontally," "higher," and "lower" refer to the up and down directions associated with the backpack 502 when it is worn by a standing bearer 501 and so corresponds to the depiction in FIGS. 28-30.

The body contacting wall 514, the vertical interior divider wall 590, a vault wall 580, the right side wall 518, and the left side wall 519 define a second internal compartment 508. The second internal compartment 508 and the first internal compartment 506 are separated from each other by the vertical interior divider wall 590. The second internal compartment 508 is adjacent the body contacting wall 514 and the first internal compartment 504 is adjacent to the non-body contacting wall 516. An opening defined in the right side wall 518, the top wall 520, and the left side wall 519 provides access to the second internal compartment 508 and is secured by a zipper 512. A lateral strap 510 is provided to reduce the tension on the zipper 512 and to cinch the top of the bag portion 504 on its left and right sides. The lateral strap 510 comprises a webbing portion attached to either the right or left side wall 518 or 519, respectively, a webbing portion attached to the body contacting wall 514, and a buckle attached to the webbing portion secured to the body contacting wall 514 with the webbing portion attached to the corresponding side wall sliding through slots in the buckle whereby the lateral strap may be tightened or loosened. The design of the lateral strap 510 is conventional.

It will be understood that the divider wall 590 could be eliminated in order to provide one internal compartment instead of two. This single internal compartment would extend the full height of the bag portion 504 on the non-body contacting side 516 but would be shallower on the body contacting side 514 due to the presence of the waist bag compartment 540.

A waist bag compartment 540 in the bag portion 504 is situated between the body contacting wall 514 and the vertical interior divider wall 590 horizontally and between the bottom wall 524 and the vault wall 580 vertically. The waist bag compartment 540 therefore is below the second internal compartment 508 vertically and between the first internal compartment 506 and the body contacting wall 514 horizontally. The waist bag compartment is bordered by the body contacting wall 514, the bottom wall 524, and the supporting vault wall 570, and portions of the left side wall 519.

The waist bag compartment 540 is accessed on the right side through an opening 526 defined between the right side wall 518, the body contacting wall 514, and the bottom wall 524. The waist bag compartment 540 is accessed on the left side through a slot opening 534 that is defined between the left side wall 519, the bottom wall 524, and the body contacting wall 514. The distance between the opening 526 and the slot opening 534 across the body contacting side 514 preferably is determined in order to facilitate the rotation of the waist bag 550 around the waist of the bearer 501, as discussed above with reference to the first embodiment in connection with FIG. 7.

Figure 30A:
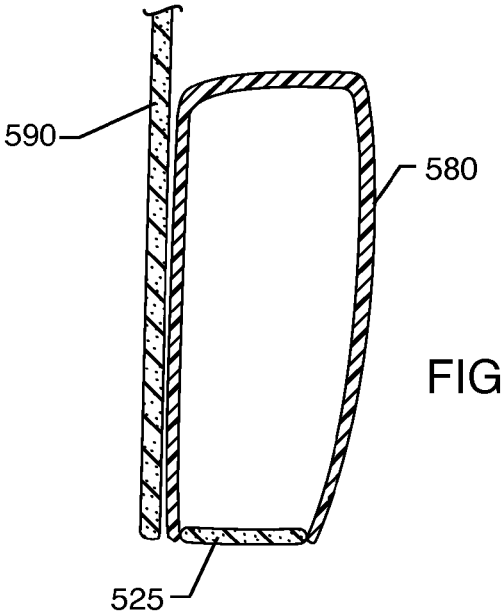
FIG. 30A is a cross-sectional view of certain structural elements that form the waist bag compartment in the backpack of the fifth preferred embodiment of a backpack with waist bag carrying system.

The vault wall 580 is essentially shaped like an inverted U when seen in cross-section as in FIGS. 28, 29, and 30A. The top of the inverted U is above the waist bag compartment 540. The vault wall 580 should have some rigidity to maintain the shape of the waist bag compartment 540 against the pressure of the bearer 501's back and the weight of articles carried in the second internal compartment 508 above the waist bag compartment 540 and in the first internal compartment 506 on the side. The receiver 552 of the waist bag 550 is more easily inserted into and removed from the waist bag compartment 540 when that compartment 540 retains a shape that can accommodate the receiver 552.

Preferably the vault wall 580 is made from a sheet of polyethylene molded or bent into the U shape. The polyethylene sheet may be further molded or indented with ribs (not shown) for additional strength and rigidity. The polyethylene sheet preferably will be paired on the interior of the U shape with closed cell foam (not shown) to provide some protection to the receiver 550 of the waist bag 550. The vault wall 580 preferably will further be lined with fabric between the closed cell foam and the compartment 540. This fabric will be attached to the fabric of the body contacting wall 514, the bottom wall 524, the right side wall 518, and the left side wall 519.

The bottom wall 524 contains a spreader layer 525, preferably made of closed cell foam, below the waist bag compartment 540. The spreader layer 525 is wide enough to provide rigidity to the bottom wall 524 below the waist bag compartment 540. A chief purpose of providing rigidity through the spreader layer 525 is to keep the shape of the "U" of the vault wall 580 by preventing the vault wall 580 from being collapsed inwardly at its lower parts. Together, the vault wall 580 and the spreader layer 525 maintain the shape of the waist bag compartment 540 by preventing the compartment 540 from being collapsed due to the pressure of the bearer 501's back against the lower part of the body contacting wall 514 and the weight of the articles carried in the inner compartments 506 and 508. Another purpose is to prevent the weight of the waist bag 550 from causing the sagging of the lower wall 524 and therefore distorting the shape of the waist bag compartment 540.

FIG. 30A shows a cross-section of the structural elements discussed above that define the waist bag compartment 540. Fabric layers, other parts of the backpack 502, and the waist bag 550 are not shown in FIG. 30A.

Figure 31:
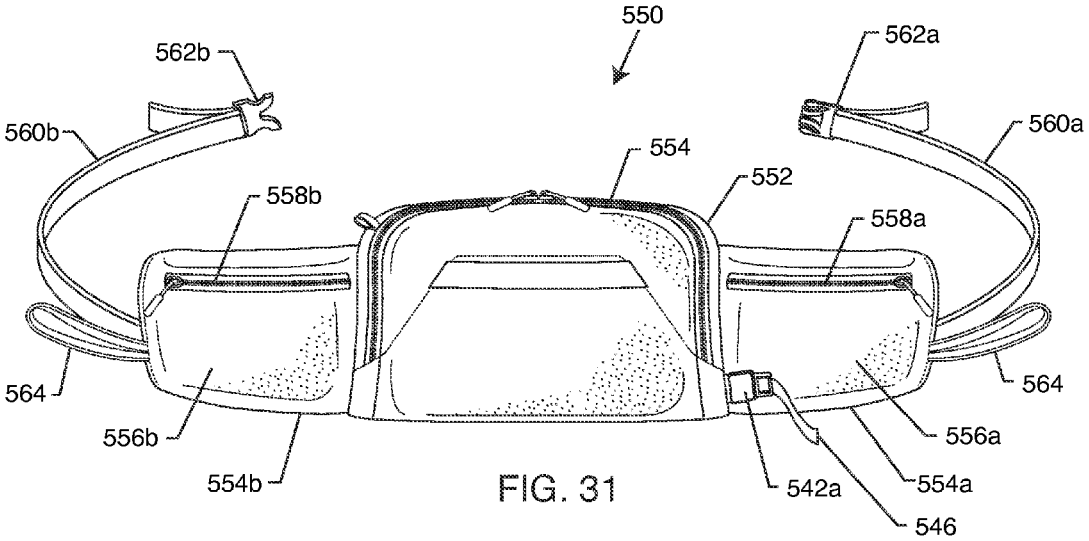
FIG. 31 is a perspective view of the front side of the waist bag of the fifth preferred embodiment of a backpack with waist bag carrying system.
Figure 32:
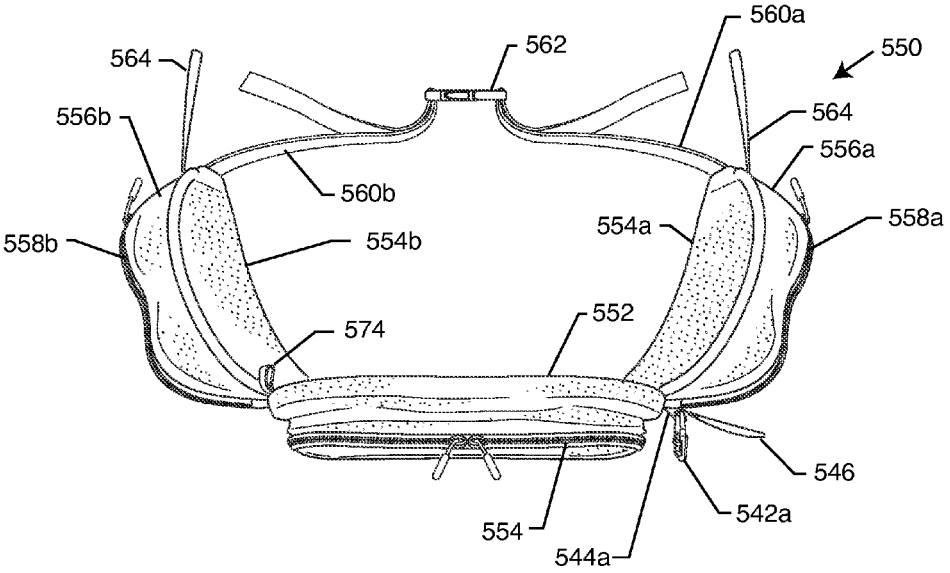
FIG. 32 is a perspective view of the top side of the waist bag of the fifth preferred embodiment of a backpack with waist bag carrying system.

The waist bag 550 comprises a receiver 552 having walls defining a compartment that is accessed through an opening secured by a zipper 554. The receiver 552 as shown in FIGS. 31 and 32 has a rectangular outline as seen from above and from the side. It is relatively narrow in order to fit in the restricted space of the waist bag compartment 540. Its compartment is suitable for accommodating tablet computers such as the IPAD MINI™ sold by Apple, Inc., smart phones, mirrorless cameras, point and shoot cameras, and documents such as passports.

The receiver 552 is sewn to right side wing 554*a* and left side wing 554*b* on the right and left side, respectively, of the receiver 552. The right side wing 554*a* and the left side wing 554*b* are padded on the sides where they contact the bearer's body and bear pouches 556*a* and 556*b* on the opposite sides. The pouches 556*a* and 556*b* are intended to contain articles, such as keys, cell phones, and the like, and may be accessed by the bearer 501 when the receiver 552 is stored within the waist bag compartment 540 as well as when the receiver 552 is deployed to the front of the bearer 501. The pouches 556*a* and 556*b* contain openings for access that secured by zippers 558*a* and 558*b*.

The pouches 556*a* and 556*b* are respectively attached to the webbing straps 560*a* and 560*b*. The webbing straps 560*a* and 560*b* are secured to each other around the torso of the bearer 501 by the buckle 566. The buckle 566 has male and female buckle components 566*a* and 566*b*, respectively, and its length may be adjusted by sliding the webbing of the waist belt 560 through either of the components 566*a* and 566*b*.

The waist bag 550 is operatively connected to the backpack 502 by extending through the waist bag compartment 540 when the waist bag 550 is fastened about the torso of the bearer 501. The receiver 552 is shaped to enter and be contained within the waist bag compartment 540 in the configuration seen in FIGS. 28 and 29. The receiver 552 also is rounded to facilitate entry of the receiver 552 into the waist bag compartment 540.

The receiver 552 is secured to the backpack 502 by the buckle 542. The buckle 542 preferably is a magnetic buckle in which an embedded magnet draws the female buckle component 542*a* toward male buckle component 542*b*. Such buckles were described above in connection with the detailed description of the first preferred embodiment. A preferred magnetic buckle is made by Fidlock and called the SNAP Helmet Buckle. The female buckle component 542*a* is attached to the waist bag 550 by the strap 544*a* and the male buckle component 542*b* is attached to the backpack by the strap 544*b*. The strap 544*a* is secured to the right side of the receiver 552 and the strap 544*b* is secured to the right side wall 518 adjacent the waist bag compartment 540. The straps 544*a* and 544*b* are arranged, as shown in FIG. 28, so that the buckle components 542*a* and 542*b* will be drawn to each other and snap together quite readily when the receiver 552 is inside the waist bag compartment 540.

As in the previous preferred embodiments, the waist bag 550 may be rotated around the torso of the bearer 501 to bring the receiver 552 to the front of the bearer 501 in the configuration shown in FIG. 30 to permit the bearer 501 to access the contents of the receiver 552, and then returned rest inside the waist bag compartment 540 in the configuration shown in FIGS. 28 and 29. The handles 564 are loops of webbing sewn to the waist bag 550 to be grasped by the bearer 501 for shifting the waist bag 550 in either direction around the waist of the bearer 501. The handles 564 are sewn to the right side of the side wing 554*a* and the left side of the side wing 554*b*. The strap 544*a* has an extension that also serves as a handle 546 for the bearer 501. The extension is formed from an end of the strap 544*a* that is opposed to the end of the strap 544*a* that is sewn to the receiver 552. The webbing of the strap 544*a* is passed through a slot in the buckle component 542*a* and sewn to itself to secure that buckle component 542*a* leaving an excess that is sewn into a loop configuration to form the handle 546.

Because the slot 534 will not permit passage of the receiver 552, the waist bag may not be rotated in either direction to remove it from the waist bag compartment 540. It will be understood that the placement of the opening 526 on the left side of the backpack 502 and the slot 534 on the right side of the backpack 502 may be reversed so the receiver 552 emerges from the backpack 502 on its left.

A tether 570 is provided to maintain a connection between the waist bag 550 and the backpack 502 even when the buckle 562 is unfastened and the receiver 552 is pulled out of the waist bag compartment 540. The purpose is the same as that of the tether system 120 of the backpack and waist bag system 1 described above. The tether 570 is a strap of webbing secured to a loop of webbing 576 sewn to the right wall 518 of the backpack 502 above and near the opening 526. The tether 570 is sewn to itself at one end into a loop that is fastened around the loop 576. The other end of the tether 570 is sewn to itself around one end of a snap hook fastener 572. The snap hook fastener 572 is attached to a loop of webbing 574 sewn to the left side of the receiver 552. (It will be understood that "left" refers to the side of the receiver that is on the left side of the bearer 501 when the receiver 552 is inside the waist bag compartment 540.)

The backpack with waist bag carrying system 500 will resemble an ordinary backpack with a waist belt when in the configuration in which the receiver 550 is secured inside the waist bag compartment 540.

While the invention has been described in conjunction with the preferred embodiment, it will be understood that it is not intended to limit the invention to this embodiment or its particular manner of construction, materials or components. On the contrary, the invention is intended to cover alternatives, modifications and equivalents that may be included within the spirit and scope of the invention as defined by the appended claims.

What is claimed is:

1. A backpack and waist bag carrying system, comprising:

a backpack comprising a bag portion attached to shoulder straps;

the bag portion comprising a body contacting wall and an opposed non-body contacting wall joined by a right side wall, a left side wall, and a bottom wall, a first internal compartment defined in the bag portion adjacent the non-body contacting wall and running between the bottom wall and the top of the non-body contacting wall, and a waist bag compartment defined in a lower part of the bag portion adjacent the body contacting wall, the waist bag compartment having opposed openings on each of the right and left sides of the lower part of the bag portion;

a waist bag comprising a receiver attached to a waist belt, wherein the waist bag extends through the openings on the right and left sides of the lower part of the bag portion and the waist bag compartment wherein the waist belt may be fastened so as to encircle a bearer's waist when the backpack is worn on the bearer's back;

wherein the receiver has a cross-sectional size and shape allowing it to be received in the waist bag compartment, whereby the bearer can rotate the waist bag around the bearer's waist, when the backpack is worn on the bearer's back, from a first position in which the receiver is contained in the waist bag compartment and adjacent the bearer's back to a second position in which the receiver is adjacent the front of the bearer; and wherein one of the openings has a cross-sectional size and shape to permit ingress and egress of the receiver through the said one of the openings and the other one of the openings is sized and shaped to restrict the ingress and egress of the receiver while permitting the waist belt to move through the said other of the openings.

2. The backpack and waist bag carrying system according to claim 1 further comprising a buckle, the buckle comprising first and second interlocking buckle components, the first buckle component being attached to the one of the right and left side walls having the opening that has a cross-sectional size and shape to permit the ingress and egress of the receiver and the second buckle component being attached to the waist bag whereby the one of the right and left side walls having the opening that has a cross-sectional size and shape to permit the ingress and egress of the receiver may be secured to the waist bag when the receiver is contained in the waist bag compartment and thereby preventing egress of the receiver from the waist bag compartment.

3. The backpack and waist bag carrying system according to claim 1 wherein the other one of the openings on the right and left sides of the lower part of the bag portion is a slot permitting the waist belt to extend through it but not permitting the passage of the receiver.

4. The backpack and waist bag carrying system according to claim 1 further comprising a shaping and supporting wall surrounding the sides and top of the waist bag compartment and having lower ends adjacent the bottom wall, the shaping and supporting wall having sufficient rigidity and strength to prevent deformation of the waist bag compartment.

5. The backpack and waist bag carrying system according to claim 4 wherein the shaping and supporting wall is shaped like a vault.

6. The backpack and waist bag carrying system according to claim 4 wherein the bottom wall comprises a layer having sufficient rigidity to maintain the separation of the lower ends of the shaping and supporting wall and thereby prevent the narrowing of the waist bag compartment adjacent the bottom wall.

7. The backpack waist bag carrying system according to claim 1 further comprising a divider wall attached to the bottom wall and the right side wall and left side wall and the first internal compartment is defined in the bag portion between the bottom wall, the non-body contacting wall, the right side wall, and the left side wall and further comprising a second internal compartment defined in the bag portion between the body contacting wall, the right side wall, the left side wall, and the divider wall, the second internal compartment being above the waist bag compartment.

8. The backpack waist bag carrying system according to claim 1 further comprising a tether having a first end connected to the backpack and a second end connected to the waist bag.

* * * * *